US005729957A

United States Patent [19]

Spada

[11] Patent Number: 5,729,957

[45] Date of Patent: Mar. 24, 1998

[54] PACKAGE FOR CYLINDRICAL PRODUCTS, PARTICULARLY CIGARETTES OR SIMILAR, AND PROCESS AND DEVICE FOR ITS FABRICATION

[75] Inventor: Valter Spada, Marzabotto, Italy

[73] Assignee: Sasib S.p.A., Bologna, Italy

[21] Appl. No.: 661,999

[22] Filed: Jun. 12, 1996

[30] Foreign Application Priority Data

Jun. 28, 1995 [IT] Italy ..... GE95A0073

[51] Int. Cl.[6] ..... B65B 31/04; B65B 11/28

[52] U.S. Cl. ..... 53/433; 53/466; 53/511; 53/234

[58] Field of Search ..... 53/432, 433, 466, 53/511, 510, 234, 233, 232

[56] References Cited

U.S. PATENT DOCUMENTS 2,720,738 10/1955 Brightwell .
3,857,221 12/1974 Schermund .

FOREIGN PATENT DOCUMENTS 0 374 712 6/1990 European Pat. Off. .
0 463 360 1/1992 European Pat. Off. .
2 346 223 10/1977 France .
2 003 817 3/1979 United Kingdom .
2 101 958 1/1983 United Kingdom .
2 206 327 1/1989 United Kingdom .

*Primary Examiner*—Linda Johnson
*Attorney, Agent, or Firm*—Larson & Taylor

[57] ABSTRACT

A package for cylindrical products, particularly cigarettes or similar, this package consisting of a wrapping sheet (2) in which the cigarettes are wrapped. The wrapping sheet consists of heat-weldable plastic material and is sealed, when wrapped around a group of cigarettes (S), by the welding of parts, flaps or wings (102, 202, 402, 502, 602, 702) overlapping each other on one or more sides of the group of cigarettes (S). A vacuum or low pressure may advantageously be created inside the sealed wrapping sheet (2). A process and device for the fabrication of the package, according to which the phase of wrapping, in other words that of folding the wrapping slip (2), is executed completely in only one station to which the group of cigarettes (S) and the wrapping slip (2) are fed and in only one subsequent folding station (P), while the welding is executed in intermediate phases or in a final phase.

13 Claims, 14 Drawing Sheets

PACKAGE FOR CYLINDRICAL PRODUCTS, PARTICULARLY CIGARETTES OR SIMILAR, AND PROCESS AND DEVICE FOR ITS FABRICATION

FIELD OF THE INVENTION

The invention relates to a package for cylindrical products, particularly cigarettes or similar, which consists of at least a first wrapping sheet in which a group of cigarettes disposed in a predetermined order with respect to each other is wrapped on all sides.

BACKGROUND OF THE INVENTION

At present, cigarettes are packaged by forming packs which may be of the soft or rigid type. In both soft and rigid packs, the cigarettes are further wrapped in an inner wrapping which generally consists of a foil slip. Soft packs are made by wrapping the cigarettes in a further outer slip made of paper, while rigid packs are made by forming a box, by folding a punched cardboard blank, around the group of cigarettes previously wrapped in the wrapping slip. The final phase of the package generally consists in the wrapping of the soft or rigid pack in a sheet of cellophane or similar which is sealed on all sides of the pack by welding, and whose function is to ensure the sealing of the cigarette package; by means of this the quality characteristics of the product are maintained for a long period.

SUMMARY OF THE INVENTION

The invention is intended to provide a package for cylindrical products, particularly cigarettes or similar, which is less expensive and complicated in respect of both the cost of materials and the fabrication process and the devices for its application, and which can make the packaging operations more rapid while maintaining and possibly improving the functions of preservation and conservation of the product when compared with the packages existing at present.

The invention achieves the above objects with a package for cylindrical products, particularly cigarettes or similar, of the type described initially, in which the wrapping sheet, consisting of impermeable material with heat-weldable areas, is wrapped around the ordered group of cigarettes and is sealed on all sides of the ordered group of cigarettes by the welding of parts, flaps or wings of the wrapping sheet which overlap each other on the corresponding sides of the group of cigarettes.

Any impermeable and/or plastic materials, such as sheets of polypropylene, thermoplastic resins such as polyvinyl butyral, known as PVB, ethylene vinyl acetate, known as EVA, or ionomeric resins, may be used as the material for the wrapping slips.

According to an improvement, a vacuum or a predetermined low pressure may also be created inside the package before or after the sealing of the wrapping.

If this is done, in addition to the simple sealing which prevents any exchange between the interior of the package and the environment, much of the oxygen and other gases which cause the chemical deterioration of the product will be removed, and consequently the product retains its initial quality characteristics for a longer period.

The cigarettes may be packaged in this first wrapping sheet alone. This sheet may have opening means such as bands for opening by tearing along a predetermined line. The wrapping sheet may be opaque, translucent or completely or partially transparent, with various colours, and special designs, motifs or decorations may also be printed on it.

The package formed by this first wrapping sheet may be the final package of the cigarettes or, in a similar way to packaging in a foil slip, may form the inner wrapping of what is known as a soft pack, a rigid pack, or other type of pack.

The invention also relates to a process of fabrication of the package, consisting of the following phases: the formation and/or feeding of a group of cigarettes in a predetermined number and order corresponding to those of the packaged state;

- the combination of the group of cigarettes with a wrapping sheet consisting of a sheet of thermoplastic and heat-weldable material in a predetermined relative position, and the insertion of these into a compartment with simultaneous folding of the wrapping sheet in a "C" shape around the sides of the group of cigarettes next to the sealed sides of the compartment;
- the formation of a tubular wrapping by folding and retaining in position flaps of the wrapping slip on the side of the group of cigarettes located at the open entry side of the compartment;
- the subsequent closure of the open ends of the tubular wrapping by the folding of wings formed by the terminal portions at the ends of the tubular wrapping projecting beyond the corresponding sides of the group of cigarettes;
- the welding, by heating to the welding temperature, of the flaps, wings or parts of the wrapping sheet which overlap each other on the various sides of the group of cigarettes.

The welding phase may be executed immediately after the folding on the corresponding side of the group of cigarettes and the mutual overlapping of each of the parts, flaps or wings, or at the end of the whole procedure of folding the wrapping slip around the group of cigarettes.

The welding may be carried out by means of microwaves, heating elements, laser beams, or other methods.

The process may also include a final phase of creation of a low pressure inside the package; this may be done either simultaneously with the sealing by welding of the wrapping slip on a predetermined side of the group of cigarettes, or after the complete sealing of the wrapping slip, for example by means of a suction needle.

The process may include subsequent further phases of formation of a further outer wrapping of the package, for example by wrapping the group of cigarettes, which have been sealed in the first wrapping, in a second paper wrapping slip, or by folding a punched cardboard blank or similar around the group of cigarettes sealed in the first wrapping slip.

According to a particularly advantageous improvement, with the use of slips of thermoplastic material, the complete formation of the package, in other words the complete folding of the wrapping slip around the ordered group of cigarettes, is executed in only two stations, namely in the station in which the group of cigarettes and the wrapping slip are fed into the compartment and in only one of the following stations, known as the folding station, the package being fully formed on exit from the folding station, and the formation of the open tubular wrapping being carried out substantially in the feed station and completed during the step of advance, more particularly in the initial portion of the step of advance, the closure of the ends of the tubular wrapping being completed simultaneously for the two opposite ends of the tubular wrapping in the subsequent folding station, while in the first step of advance and in the subsequent step of advance the fully formed wrapping is simply kept closed and subjected to the action of means of welding the overlapping parts, flaps or wings.

The process includes the folding of the wrapping slip for the closure of the open sides in such a way that the flaps or wings are folded in succession so that they overlap each other at least partially, from the innermost to the outermost ones, at a speed higher than the speed of elastic return to the substantially unfolded position or to an intermediate position of folding of the wings or of the flaps, while the final outer flap or wing is kept in the folded position against the corresponding side of the group of cigarettes and against the other inner flaps or wings until the group of cigarettes, wrapped in this way in the wrapping sheet, is discharged.

Alternatively, the process provides for leaving free on the inner flaps or wings at least one peripheral strip to be overlapped by an outer flap or wing, this peripheral overlap strip being provided on a side directly adjacent, next to or facing the subsequent outer flap or wing, or a part of the flap or wing which is folded into position first, the inner wing or flap being retained in the folded position only until the outer folding wing or flap at least partially overlaps the free overlap strip.

The invention also relates to a device for the application of the process, comprising:

means for forming an ordered group of cigarettes;

means for feeding the group together with a wrapping slip into a compartment open at least at one entry side and at two sides transverse with respect to the entry side;

means of transporting the compartment;

moving and/or stationary folding means which are distributed along the path of the compartment for the group of cigarettes to be packaged and for the associated wrapping slip, these means being designed to fold the wrapping slip around the group of cigarettes to form a first tubular wrapping and subsequently to close the tubular wrapping at its open ends.

According to the invention, there are provided, along the path of the compartment, after all the stations or after each station for folding the parts or flaps or wings which overlap each other on at least one side of the group of cigarettes, means for welding the parts, the flaps or the wings together to provide a hermetic seal of the wrapping of the package.

The device according to the invention may alternatively have means, which can be operated and stopped, for creating a low pressure or a vacuum inside each package.

The moving and/or stationary folding means may advantageously be provided only in the feed station and in only one of the subsequent stations, that is a folding station for the completion of the wrapping of the package.

The folding means are made in such a shape with respect to the flaps or wings and/or are operated in such a way that they terminate or stop at a certain distance from a free edge of the flaps or the wings, leaving free a partial or complete strip for the overlapping of the next flap or the next wing, on the side which is reached first by the folder of the next wing or the next flap, the folding means and the operating and synchronizing means being made in such a way that the folding means of the inner wings or flaps and those of the wings or flaps directly outside them do not interfere with each other, while means are provided to advance the start of the folding travel of the folding means of the outer wing or flap with respect to the return travel of the folder of the flap or wing immediately below, this advance corresponding to the travel required for the overlapping of the outer flap or wing onto the free peripheral strip for the overlapping of the inner flap or wing.

The invention also relates to other characteristics which further improve the package, the process and the device for its fabrication described above, and which form the subject of the dependent claims.

BRIEF DESCRIPTION OF THE DRAWINGS

The particular characteristics of the invention, and the advantages derived therefrom, will be understood more clearly from the description of certain preferred embodiments, illustrated by way of example and without restriction in the attached drawings, in which.

DESCRIPTION OF THE PREFERRED EMBODIMENTS

Figure 1:
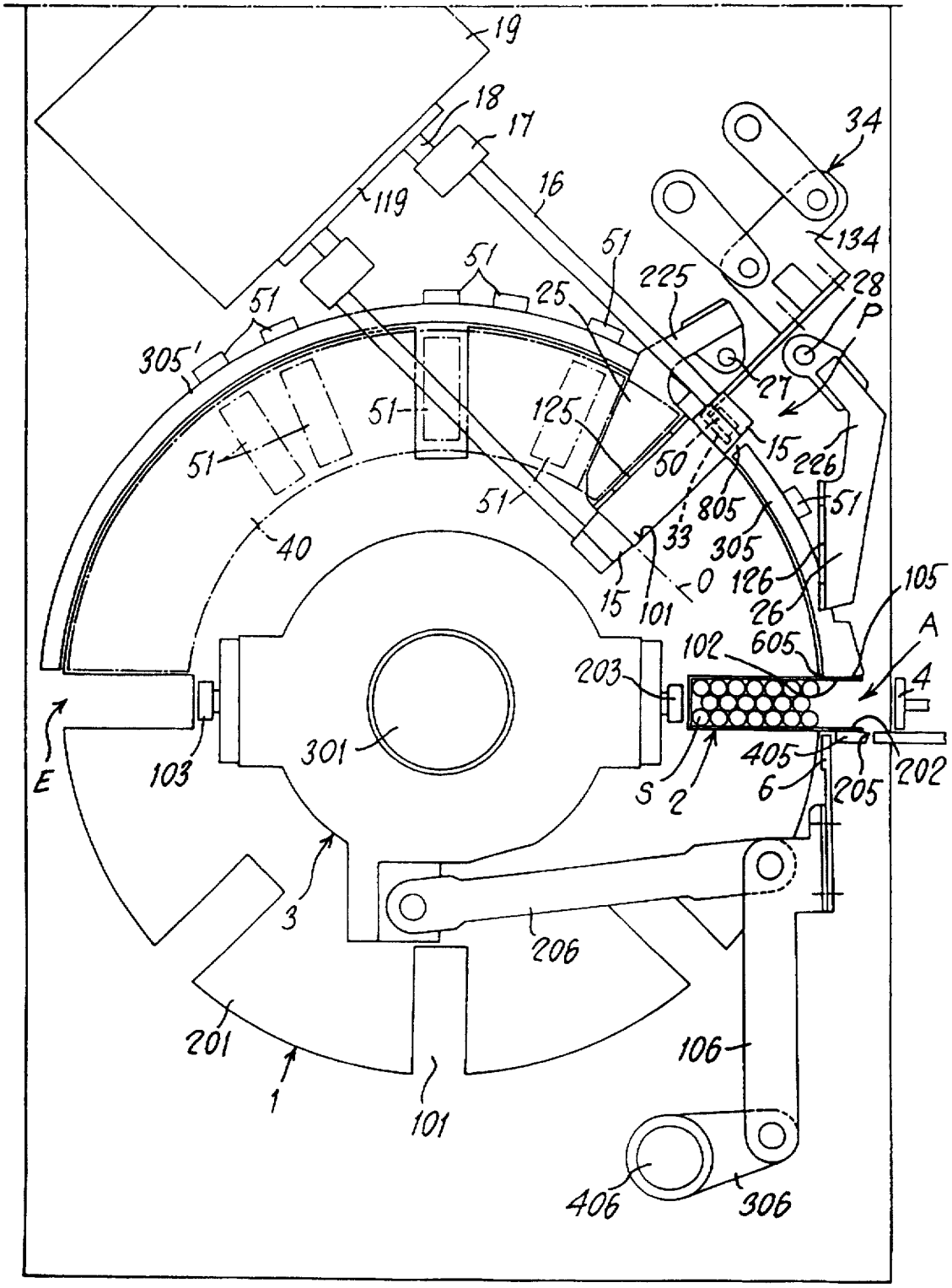
FIG. 1 is a schematic front view of a forming wheel provided with welding devices and means for creating a low pressure or vacuum according to the invention.

With reference to the figures, a cigarette packing machine comprises a conveyor drum 1, known as a forming wheel, which is supported rotatably about its own axis on a shaft 301 from which it projects. The forming wheel 1 has a plurality of peripheral radial compartments 101, each of which houses a group of cigarettes S together with a wrapping slip 2 for the said group of cigarettes. The compartments 101 are distributed at equal angular intervals around the circumference of the forming wheel 1 which is made to rotate in steps whose angular size is equal to the angular distance between the individual compartments 101.

In the central area of the wheel, between the two discs 201 which form the wheel 1, there is provided a pusher/follower group indicated as a whole by the number 3, which has an expelling pusher 103 and a follower 203 on diametrically opposite sides. The expelling pusher 103 and the follower 203 can be made to slide in diametrically opposite directions to each other and interact with the group of cigarettes S together with the slip 2 in the feed station A and with the group of cigarettes wrapped in the wrapping slip 2 in the expulsion station E on the diametrically opposite side. The group of cigarettes S has a predetermined number of cigarettes into an ordered arrangement identical to that which the cigarettes are designed to have in the packaged state. The group of cigarettes S is orientated with the axes of the cigarettes parallel to the axis of the forming wheel 1, while the ends of the cigarettes are disposed substantially flush with the outer sides of the discs 201. The group of cigarettes is formed by the feeding of a specified number of cigarettes into compartments of predetermined shape associated with a conveyor belt, known as a box conveyor, which is not illustrated and is known. Each group of cigarettes is then conveyed to a transfer station and then to a station for combination with a wrapping slip. In the station for combination with a wrapping slip, the group of cigarettes is disposed to coincide with the complementary compartment 101, in front of the open entry side of the compartment, in such a way that it can be introduced into the compartment by a movement in a direction which is transverse with respect to the cigarettes and radial with respect to the forming wheel 1. In the combination station, a wrapping slip 2 is fed to the transverse side of the group of cigarettes S, while the slip and the group of cigarettes are held in position and then transferred together into the compartment 101 by a feed pusher 4 which interacts with the follower 203 and can be moved together with it. On insertion into the compartment 101, the wrapping slip is automatically folded around the sides of the group of cigarettes S inside the compartment 101, while its axial flaps 102, 202 project radially from the entry aperture of the compartment 101.

The folding of the wrapping slip 2 around the ordered group of cigarettes at the time of insertion into the compartment 101 is caused by two opposite folding edges 105, 205 of a stationary aperture 5 which is provided in a position coinciding with the open side of the compartment 101 in the feed station A, and which is made in a stationary cylindrical coaxial peripheral wall 305 which extends around the forming wheel 1.

A tangential folder 6 is supported so that it can be moved parallel to its extension and alternately in each direction, in other words in the direction of advance of the forming wheel 1 and in the opposite direction, substantially along a path tangential to the forming wheel 1, or to the open side of the compartment 101 in the feed station A. The folder is mounted on the upper end of an arm 106 which forms part of a hinged system of levers 206, 306, 406.

Figure 4:
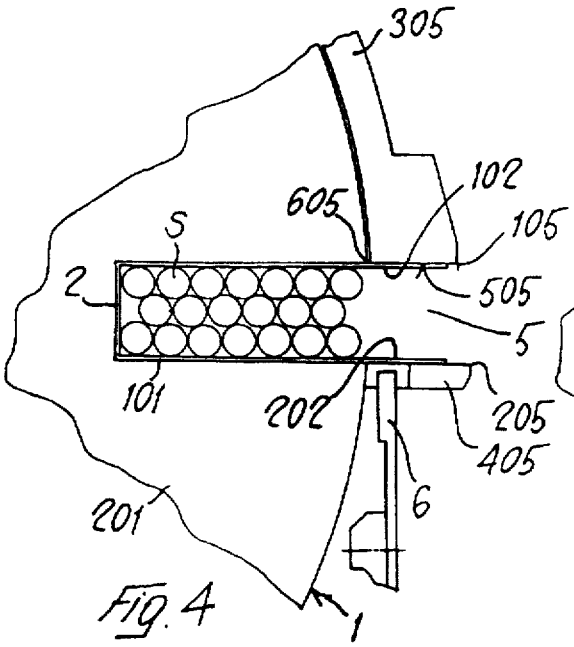
FIGS. 4 to 7 are schematic views of four phases of folding of the wrapping slip for the formation of a tubular wrapping.
Figure 5:
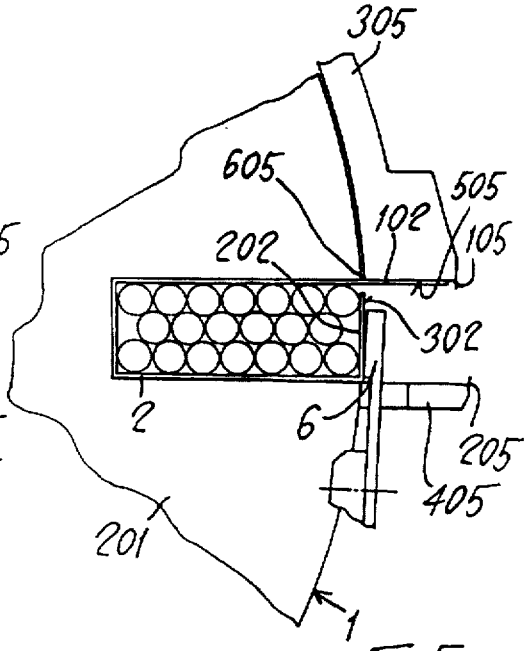

FIGS. 4 to 7 show the phases of folding the flaps 102, 202 of the wrapping sheet 2 for the formation of a tubular wrapping which is open at the ends and whose axis is parallel to the axes of the cigarettes S and to the axis of the forming wheel. The lengths of the two flaps 102, 202 are such that, when folded onto the side of the group of cigarettes coinciding with the open side of the compartment 101, they overlap each other by a certain amount. In the starting condition as shown in FIG. 4, the flaps 102, 202 extend along two horizontal radial walls 405, 505 which are aligned flush with the folding edges 105, 205 of the aperture 5. During the phase of standing in the compartment 101 in the feed station A, the tangential folder 6 starts the folding travel, by which it moves in the direction of advance of the forming wheel 1 and substantially tangentially to the wheel (FIG. 5). The flap 202 is consequently folded onto the corresponding side of the group of cigarettes S. The forming wheel 1 undergoes the step of advance with a predetermined delay with respect to the advance travel of the tangential folder 6. This delay and the two speeds of advance of the forming wheel 1 and of the folder 6 are set in such a way that the folder 6 completes its travel with respect to the flap 202 of the wrapping slip 2 in a position such that the front edge of the folder 6 is withdrawn through a certain distance from the free front edge of the flap 202, forming a free front strip 302. The folding edge 605 of the said flap 102 brings this flap into a position in which it partially overlaps the rear flap 202, on the strip 302.

Figure 6:
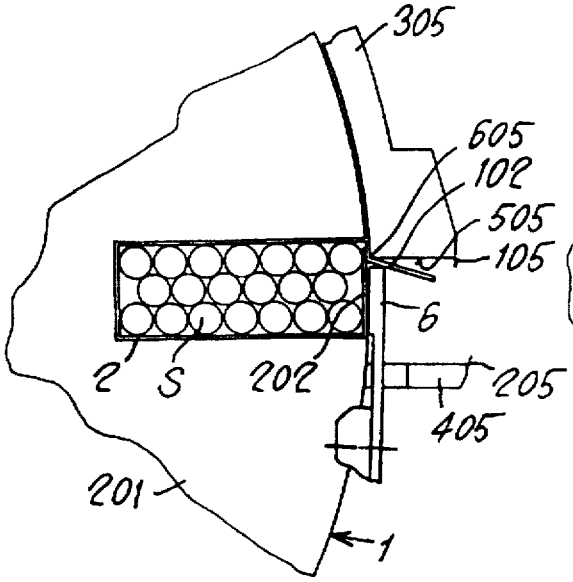
Figure 7:
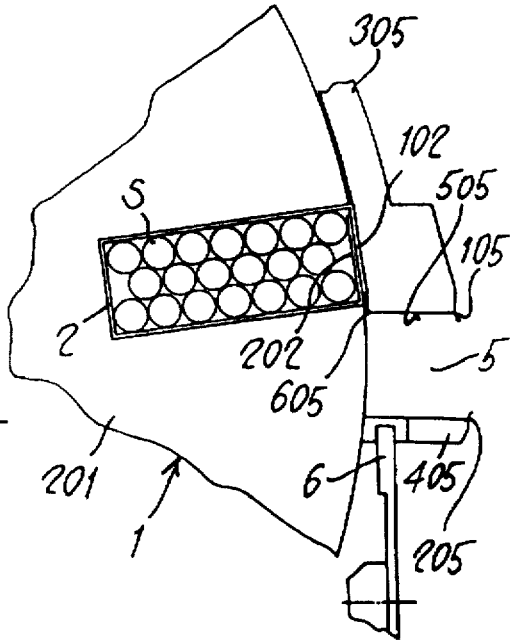
Figure 8:
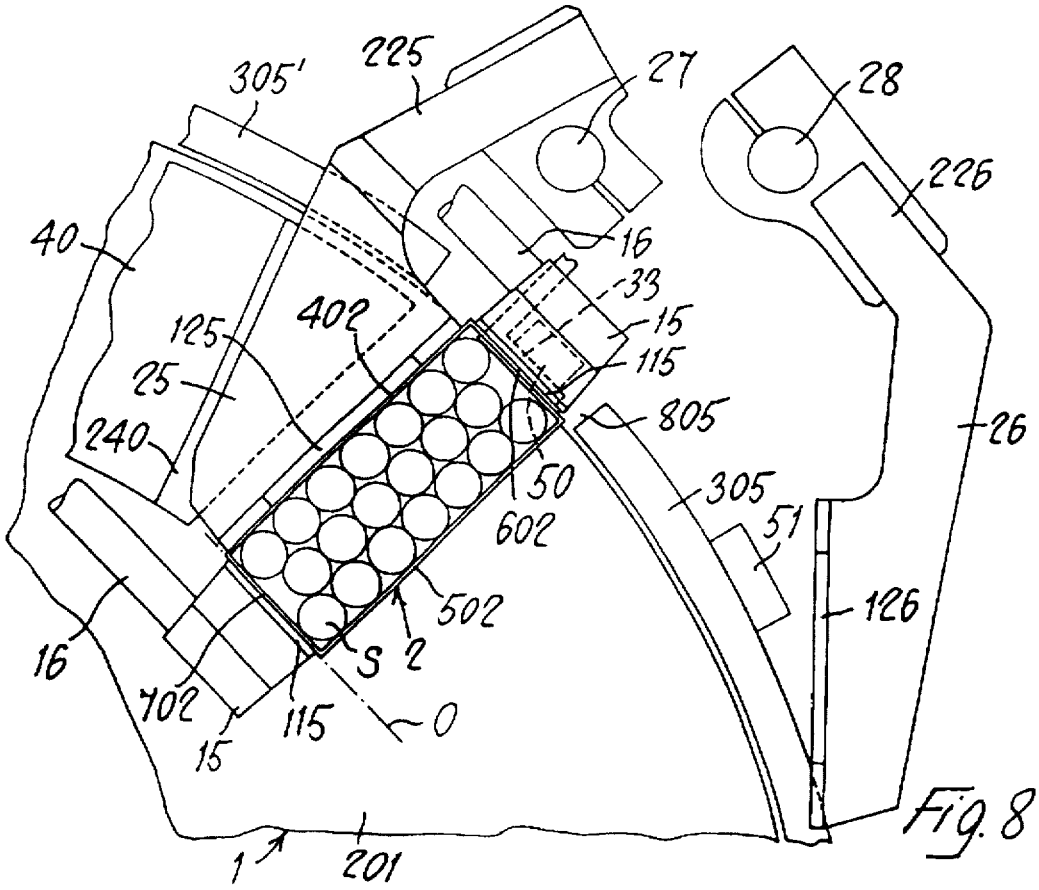
FIGS. 8 to 13 are schematic views showing, with respect to a single end of the ordered group of cigarettes, the phases of closing the tubular wrapping on the end.

As shown in FIG. 6, when a fixed relative position of the tangential folder 6 and the rear flap 202 has been reached, the folder 6 is made to approach the folding edge 605 of the front flap 102. The extension of the front overlap strip 302 in the direction of advance of the forming wheel 1 and the folding travel of the folder 6 in the direction of advance of the forming wheel 1 are such that the tangential folder 6 reverses its travel at a predetermined minimum distance from the folding edge 605 of the front flap 102. When the said minimum distance is reached, the front overlap strip 302 of the rear flap 202 has penetrated beneath the folding edge 605, which has overlapped onto it, by folding, a partial initial portion of the front flap 102. In these conditions, the folded rear flap 202 is kept in position by the front flap 102 which is partially overlapped onto it and the folder 6 can depart completely from the position of folding the associated rear flap 202, moving into the withdrawn start position for a new folding travel. Meanwhile, the advance of the forming wheel 1 causes the completion of the folding of the front flap 102 onto the corresponding side of the group of cigarettes. During the step of advance, and up to the subsequent folding station P, the flap 102, which is in a position overlapping all the remaining flaps, is kept in the folded position by the cylindrical surface of the wall 305.

In the subsequent folding station P, folding means are provided to close the open ends of the tubular wrapping which was formed in the feed station A and completed in the initial part of the step of advance of the compartment 101.

Figure 9:
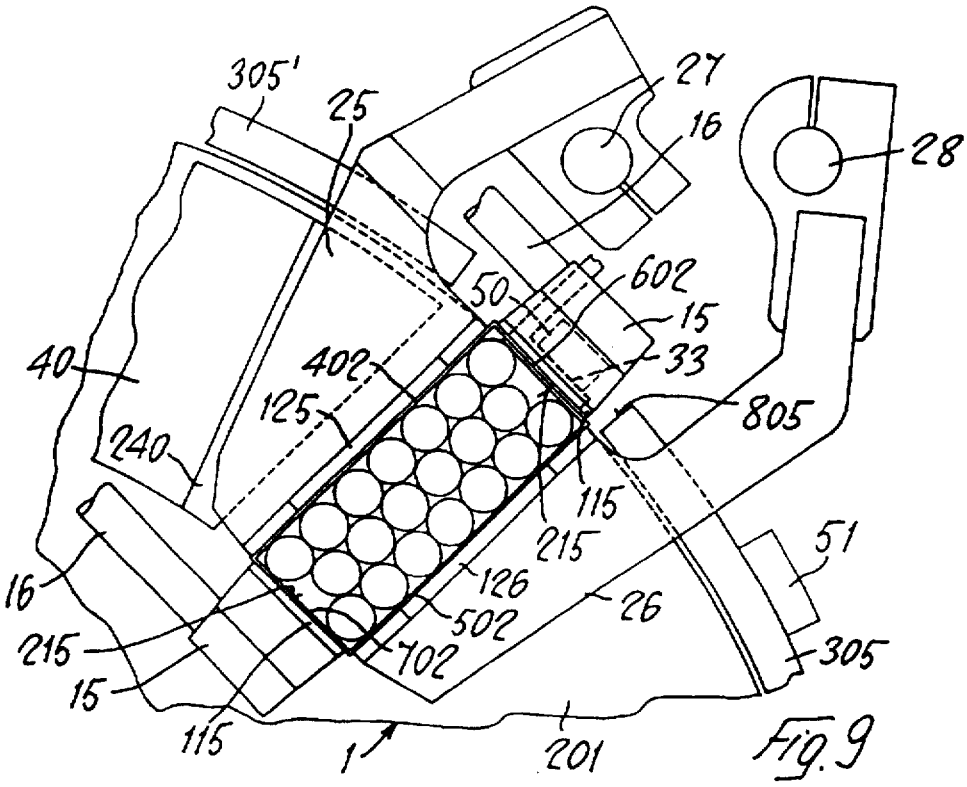
Figure 10:
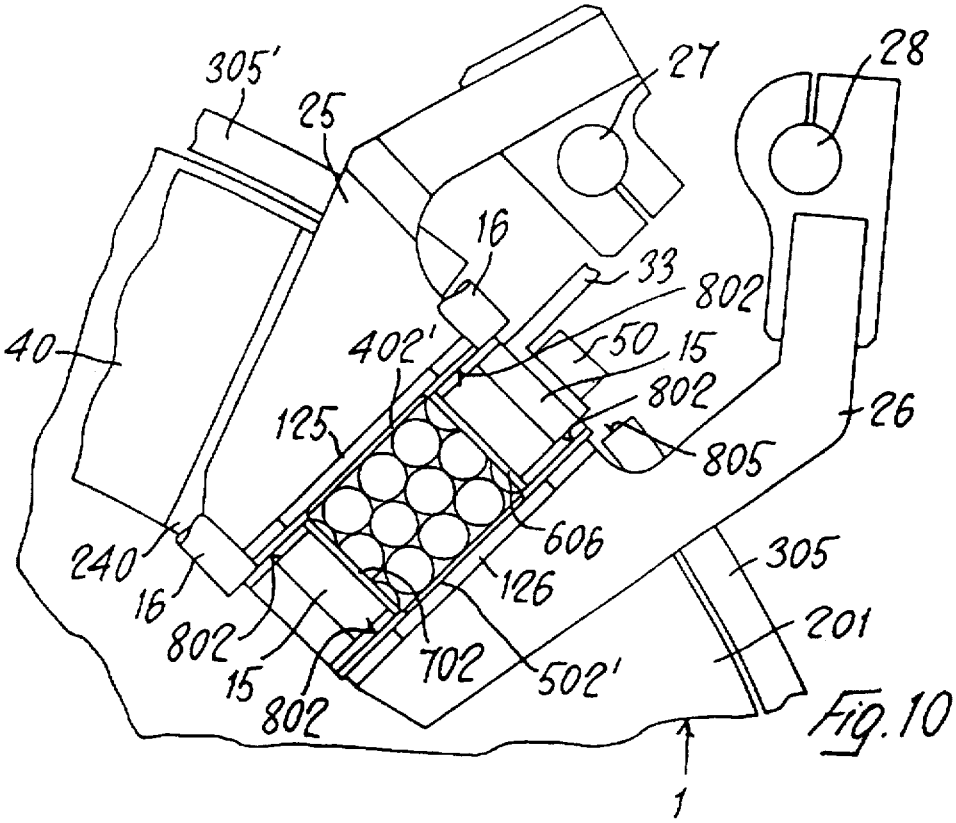
Figure 11:
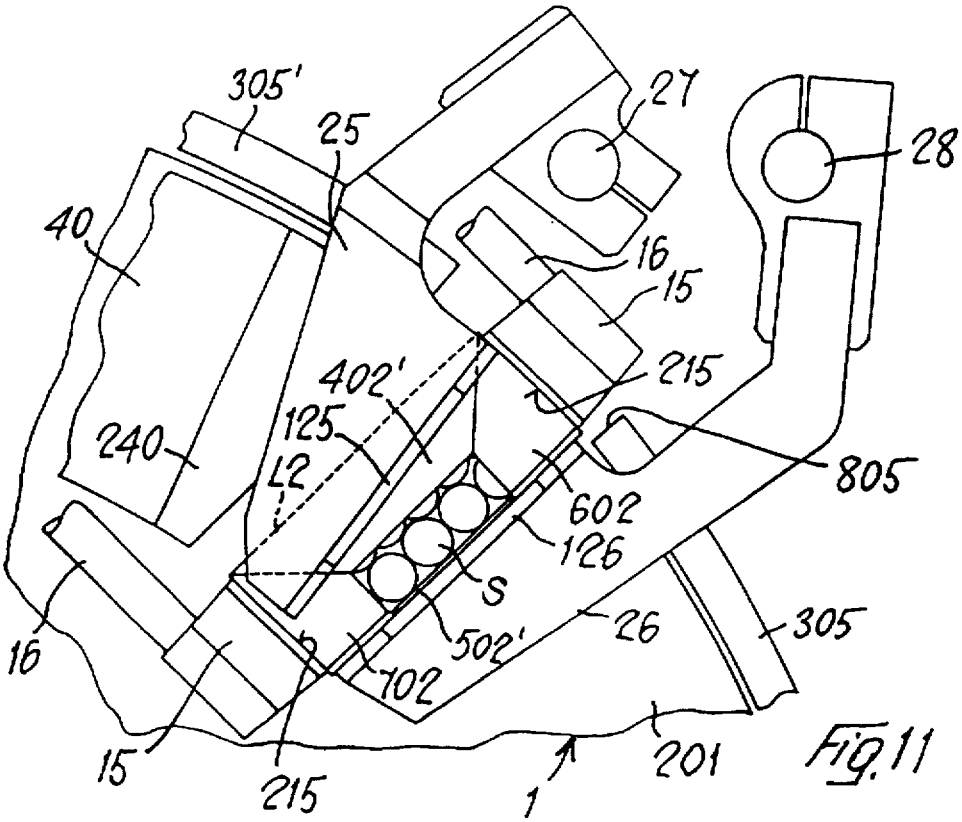

The tubular wrapping formed by the slip 2 projects beyond the ends of the cigarettes which are aligned with each other with tubular end portions which form opposite pairs of wings orientated in the radial direction 402, 502 and in the tangential direction 602, 702 with respect to the forming wheel 1, these wings being connected together at the axial contact edges. With reference to FIG. 1, a pair of blocks 15 for folding the radially inner tangential wing 602 and the radially outer tangential wing 702 is provided on each side of the forming wheel 1 at the folding station P. The folding blocks 15 are disposed outside the corresponding wings 602, 702, and each has a folding surface 115 terminating in a free edge substantially coinciding with or directly adjacent to the folding line L1 of the corresponding wing 602, 702 which coincides with the edge of the corresponding side of the group of cigarettes. The free edge may advantageously consist of a sharp edge 215 of the folding block 15, while the surface 115 in the rest position is disposed so that it diverges, in the radial direction with respect to the forming wheel 1, from the wing 602, 702. By this arrangement, the group of cigarettes wrapped in the tubular wrapping can be introduced between the four folding blocks 15 in the rest position without any possibility of the interference of the blocks with the projecting ends of the tubular wrapping, which would cause unplanned and undesirable folds. The blocks 15 can swing about an axis O which coincides with the edge 215. For this purpose, as shown in FIG. 1, each folding block 15 is supported by a bar 16 which is parallel to the axis of oscillation O of the folding blocks 15. One end of each bar 16 is fixed to the end of a radial arm 17 which rotates integrally with a shaft 18. The folding block 15 is fixed to the opposite end of the bar 16 and projects in such a way that the connecting line between the axis of the bar 16 and the edge 215 is axially aligned with the radial arm 17, while the edge 215 is made to coincide with the extension of the axis O of the shaft 18. The shafts 18 are supported freely rotatably in a wall 119 of a box 19, and their inner ends are mechanically connected to synchronized drive means. A pair of opposing folding blades 25, 26 is provided on each side of the forming wheel 1 to fold the radial wings 402, 502 of the ends of the tubular wrapping projecting beyond the ends of the cigarettes S. The folding blades extend parallel and tangentially to the plane containing the ends of the cigarettes, and can be swung parallel to each other in the said tangential plane alternately in the direction of advance of the forming wheel 1 and in the opposite direction along a path forming a secant of the forming wheel 1. The folding blades 25, 26 have transverse extensions 125, 126 on the sides facing the corresponding radial wings 402, 502. The path of oscillation of the folding blades 25, 26 is such that, during the phase in which the compartment 101 is stationary in the folding station P, they can move into a stand-by position (FIG. 9) in which they are swung into a position where the extensions 125, 126 are aligned with the outer surfaces of the corresponding sides of the tubular wrapping, and where they contact the associated wings 402, 502, thus forming containment surfaces for the wings 402, 502, substantially as axial extensions of the corresponding radial walls of the compartments 101. Each blade 25, 26 is supported on and projects from an arm 225, 226. Each arm 225, 226 is fixed at its end to an associated drive shaft 27, 28 and rotates integrally with it. Each drive shaft 27, 28 carries the two corresponding folding blades 25, 26 on the two opposite sides of the forming wheel 1.

With reference to FIG. 1, in order to allow for the presence of the radially outer folding blocks 15, the cylindrical peripheral wall 305 which surrounds the forming wheel 1 has an aperture, or rather an interruption, 805 at the folding station P. A retaining plate 33, supported so that it can alternately approach and withdraw from the side of the group of cigarettes wrapped in the tubular wrapping, is therefore provided to keep the flaps 102, 202 on the radially outer side of the tubular wrapping in the folded position without interfering with the folding blocks 15. The retaining plate 33 is slightly shorter than the axial extension of the corresponding side of the group of cigarettes S. The retaining plate 33 is supported at the end of a radial arm 134 of a system of hinged levers 34. The operation of the folding blocks 15, the folding blades 25, 26 and the retaining plate 33 in synchronization with the steps of advance of the forming wheel 1 and with each other is provided by taking the motive power from a common motor or a common power take-off which may advantageously be the power take-off for the forming wheel.

FIGS. 8 to 18 show some phases of the folding of the radial and tangential wings 402, 502, 602, 702 which form the end portions of the tubular wrapping projecting beyond the ends of the group of cigarettes. In the folding station P, the compartment 101 coincides with the aperture 805 in the peripheral cylindrical wall 305 and the retaining plate 33 is brought next to the folded and overlapped axial flaps 102, 202 of the wrapping slip 2 to keep them in position.

The front folding blades 25 are in the rest position, in which their extensions 125 and the folding edge are aligned with the corresponding front radial wall of the compartment 101, so that the front radial wings 402 are made to bear on the extensions 125 of the blades 25. The blocks 15 are in the rest position, with the edge 215 of the folding surface 115 disposed on the folding line L1 of the tangential wings 602, 702, while the folding surface 115 diverges from the wings 602, 702. The rear folding blades 26 are then swung in the direction of advance of the forming wheel into a stand-by position in which they are disposed in alignment, similarly to the facing front folding blades 25, with the corresponding radial side of the compartment 101. The blocks 15 are then (FIGS. 10, 15 and 16) swung into the position in which the associated tangential wings 602, 702 are folded onto the corresponding end of the group of cigarettes S. In this condition, with the tangential wings 602, 702 connected along the axial edges to the radial wings 402, 502, a substantially triangular part 802 of the ends of the radial wings 402, 502 is refolded, simultaneously with the folding of the tangential wings 602, 702, onto the inner sides of these wings, while at the corner area of the end of the group of cigarettes the wrapping material has to change from a substantially convex condition to a substantially concave condition, for which purpose the corresponding corner area 315 of the folding block 15 is chafered and/or rounded. In this folded condition, each radial side 402' and 502' is in the shape of an isosceles triangle whose longer base coincides with its folding line L2 i.e. is tangential or coincides with the radial edge of the end of the group of cigarettes S.

The folding blocks 15 are then (see FIGS. 11 and 17) swung again into the rest position, while the front folding blade 25 is operated and, with an angular movement tangential to the end of the group of cigarettes and in a direction opposite to the direction of advance of the wheel, causes the front radial flap 402' to be folded onto the end of the group of cigarettes and in a condition in which they overlap the previously folded tangential wings 602 and 702. The whole takes place at a speed which is higher than that of the elastic return of the tangential wings to their unfolded or partially folded condition and is sufficient to prevent them from assuming a position which adversely affects the correct folding of the slip on the ends of the group of cigarettes.

At least the perpendicular extension 125 of the front folding blade 25 has a trapezoidal shape, substantially identical to the trapezoidal shape of the radial flaps 402', 502'. This enables the wait time of the operation of the folding blade 5 to be reduced, since it can start with a certain advance, while the folding blocks 15 have completed only part of the return travel and are in a position of intermediate elevation in which the angle between the folding surface 115 and the end of the group of cigarettes is slightly greater than the angle between the inclined sides and the base of the trapezoidal extension 125 of the folding blade 25. The latter may therefore be inserted under the folding blocks 15 when they are still at an intermediate point of the return travel.

Figure 12:
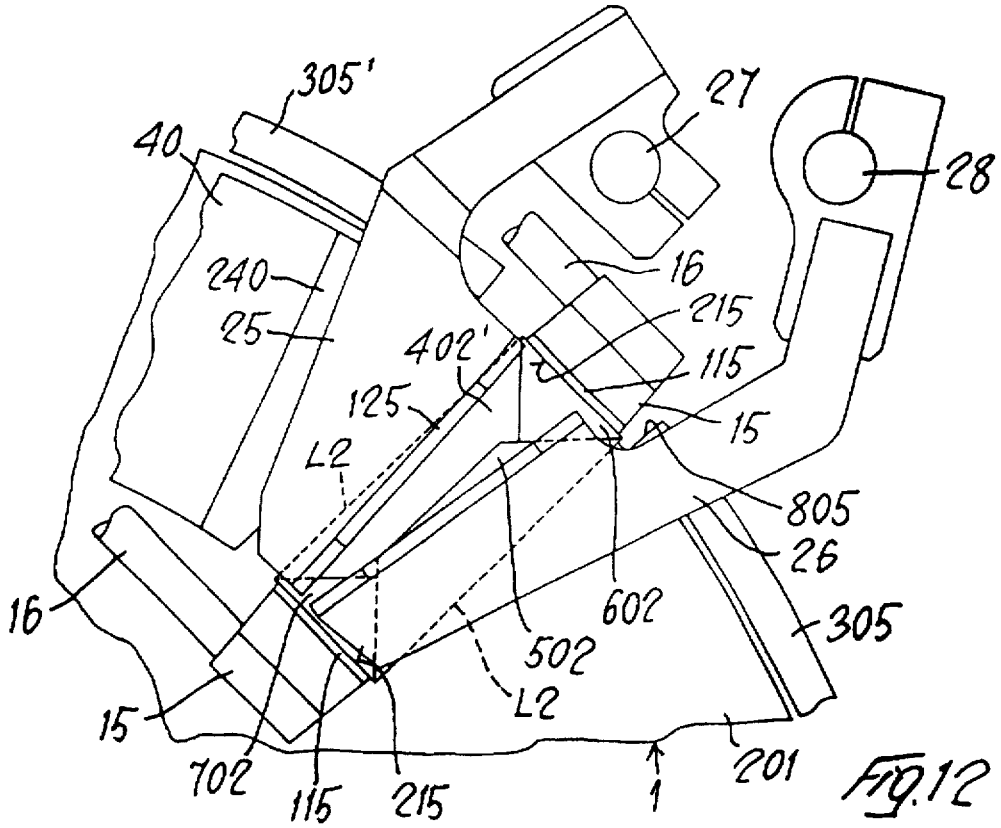

The rear folding blade 26 is operated before the start of the return travel of the front folding blade 25, and is swung in the direction of advance of the forming wheel 1 towards the front folding blade 25 up to a certain distance from it. When this minimum approach distance is reached, the front folding blade 25 starts the return travel at a speed substantially equal to that of the rear folding blade 26. The folding travel of the rear blade 26 and the return travel of the front blade 25, as well as the path of the facing folding edges of the folding blades 25, 26 and the minimum distance between these, are set in such a way that in the terminal parts of the folding and return travels the rear folding blade 26 is superimposed, directly or with the interposition of the rear radial flap 502, at least partially on the front radial flap 402, while the front blade 25 is still superimposed on the front edge of the end of the group of cigarettes (FIG. 12).

Figure 13:
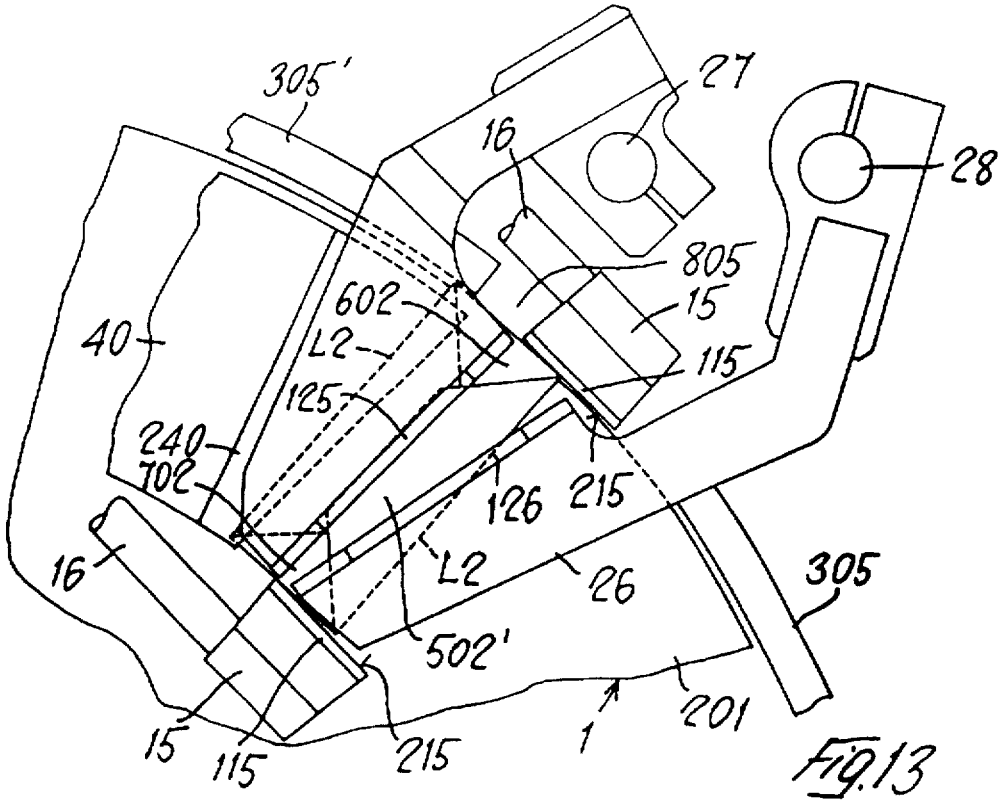
Figure 14:
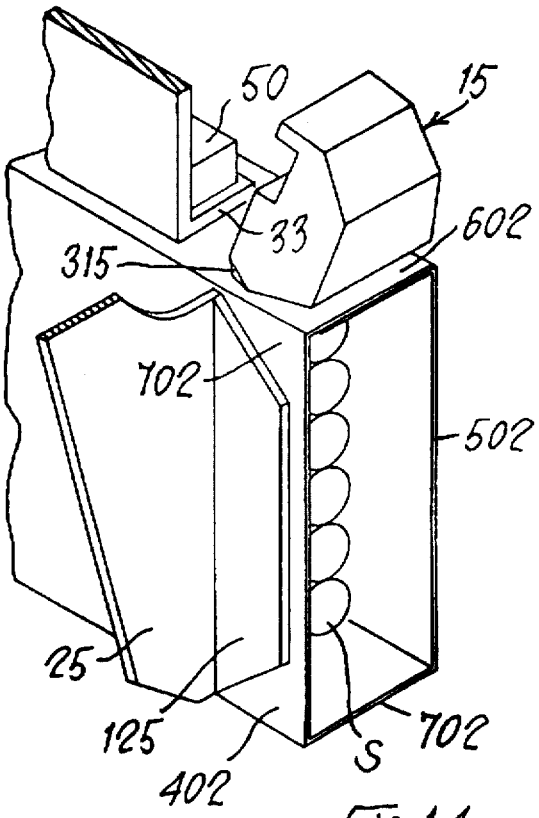
FIGS. 14 to 17 show in perspective and in a more schematic way the phases of folding the projecting flaps of the tubular wrapping as shown in FIGS. 8 to 13.
Figure 15:
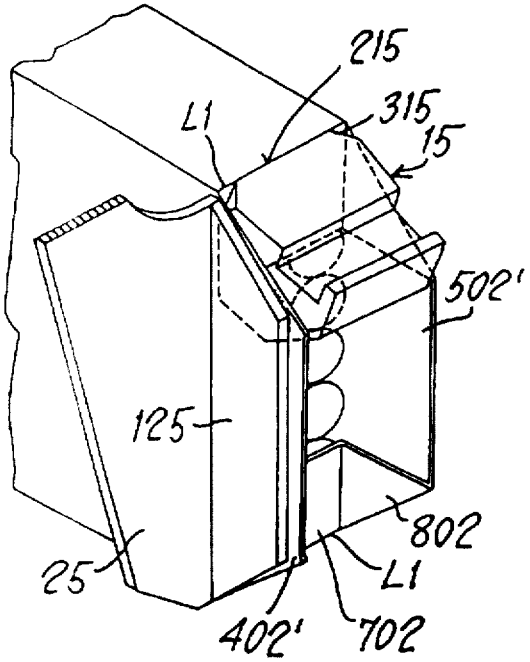
Figure 16:
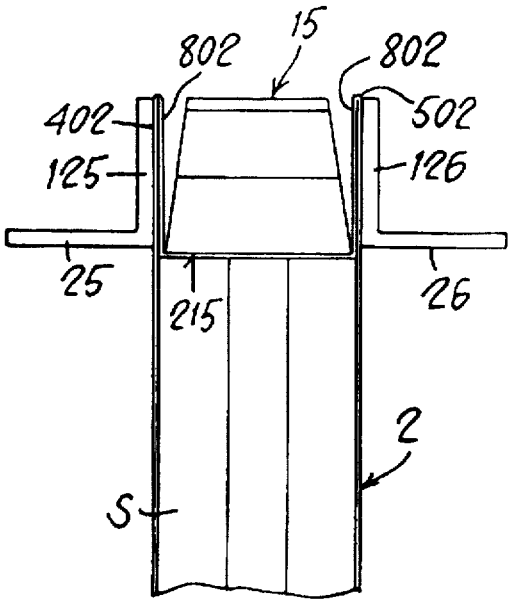
Figure 17:
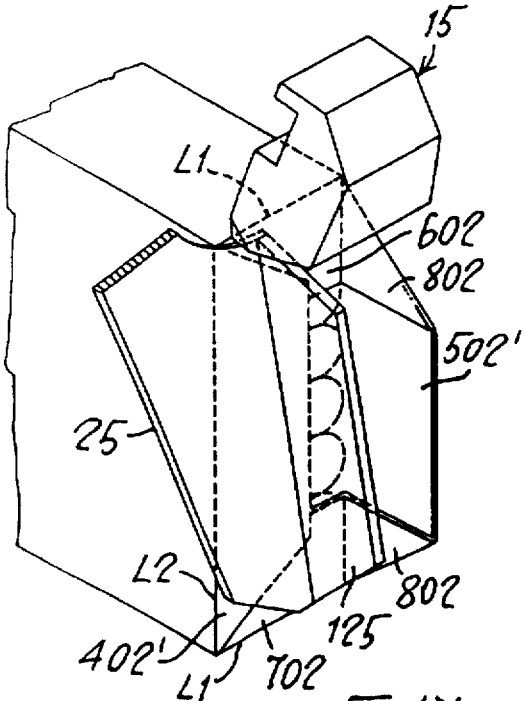
Figure 19:
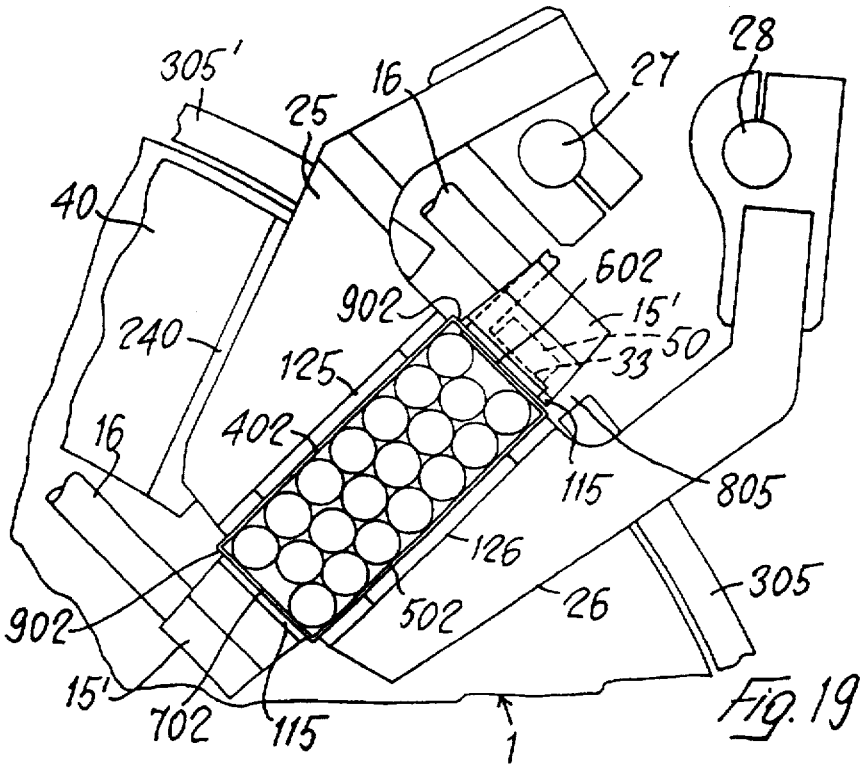
FIGS. 19 to 22 show some phases of the folding of the projecting ends of the tubular wrapping for the closure of the ends of the wrapping according to a variant embodiment of the invention.
Figure 22:
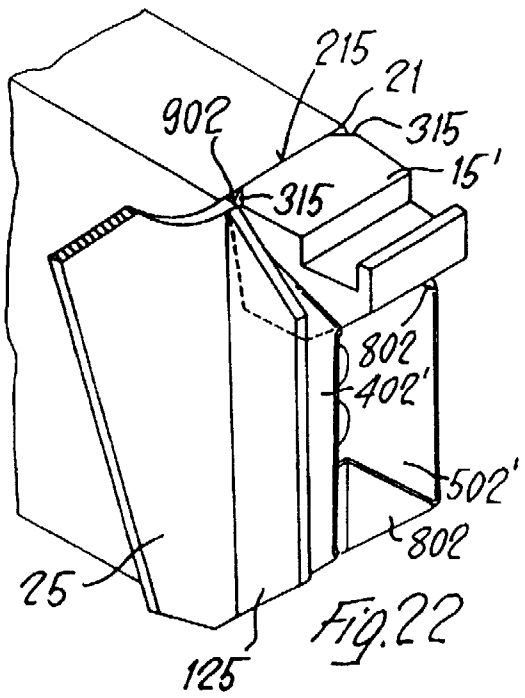
Figure 21:
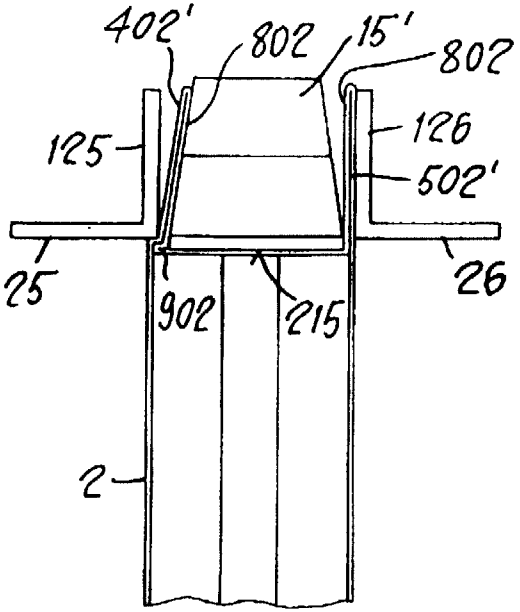
Figure 24:
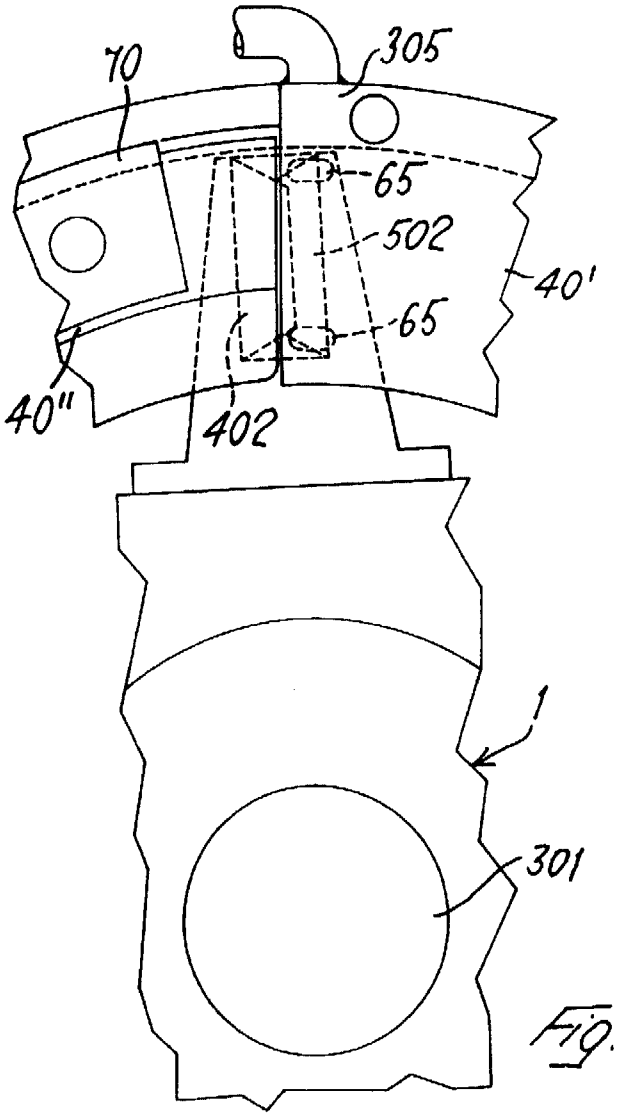
FIG. 24 is a an axial and partial view of the wheel, showing only the station for air suction and/or injection from and into the group of cigarettes wrapped in the wrapping slip.
Figure 26:
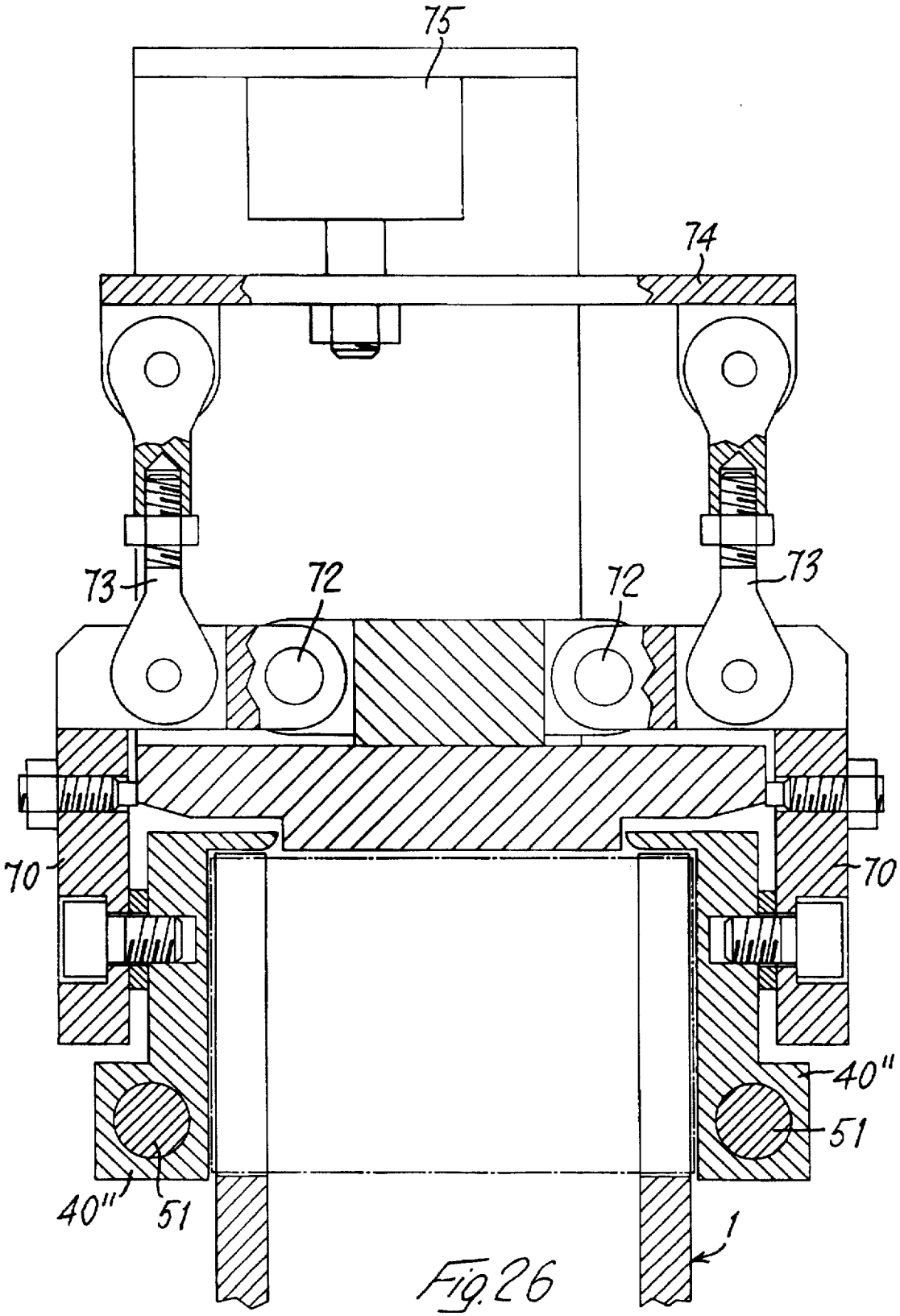
FIG. 26 is a view in partial section, with respect to a radial plane, of the forming wheel, showing the area in which are located the means for welding the ends of the wrapping of the group of cigarettes.

The forming wheel undergoes the step of advance, while the two folding blades 25, 26 end their simultaneous travel in the direction of advance of the forming wheel, and then the rear folding blade 26, with a certain delay with respect to the execution of the step of advance, returns to the initial position at a speed lower than that of the step of advance of the compartments 101 (FIG. 13). The group of cigarettes is therefore moved relative to the folding blades 25, 26 in the direction of advance of the wheel 1. The whole is adjusted and designed in such a way that, as shown in FIG. 19, the end of the outer rear radial wing 502' which is free and turned in the direction of advance of the forming wheel 1 is inserted in a pleated state under the folding edge of the front folding blade 25, while the rear blade 26 is still partially superimposed on an area on the opposite side of the outer rear radial wing 502'. With reference to FIG. 24, the folding edge of the folding blade 25 has a chamfered or rounded guide area 225 for this purpose.

Figure 18:
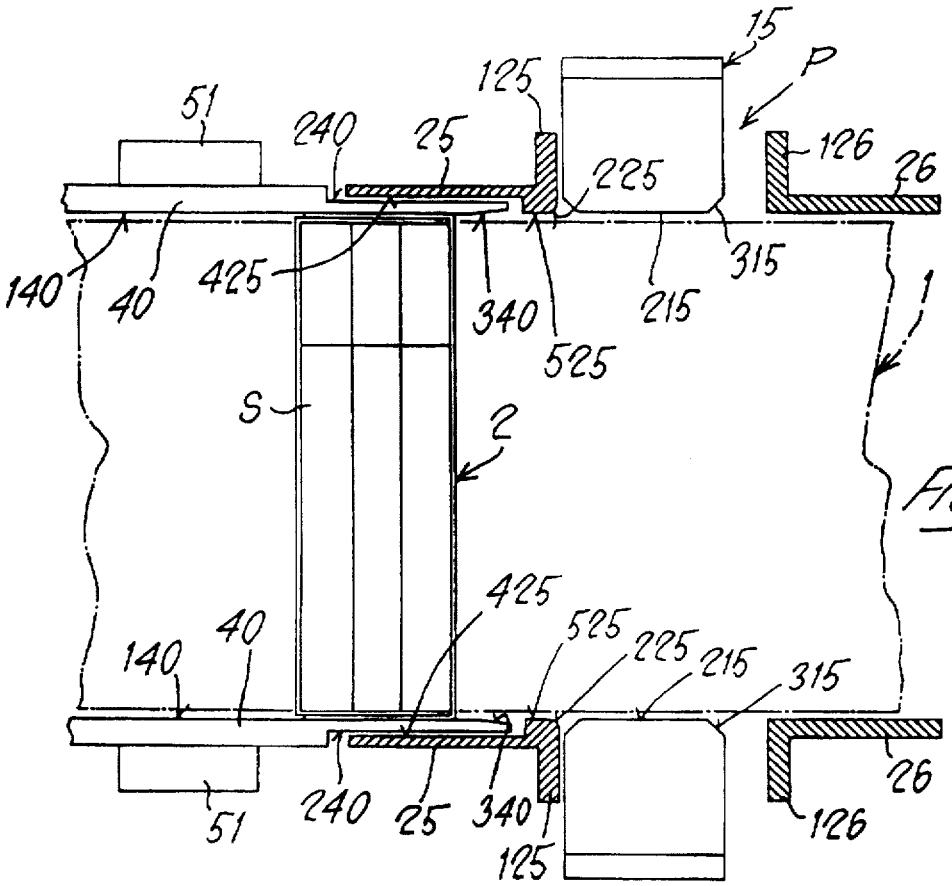
FIG. 18 shows the wrapped group of cigarettes leaving the folding station together with means for retaining the folded-flaps in the folded position.
Figure 20:
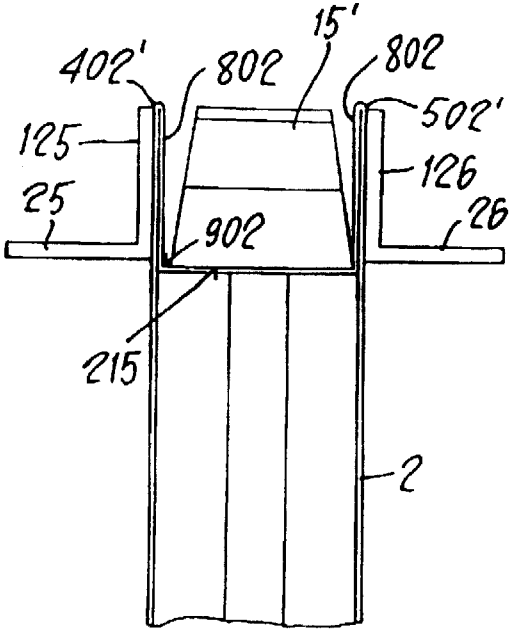
Figure 23:
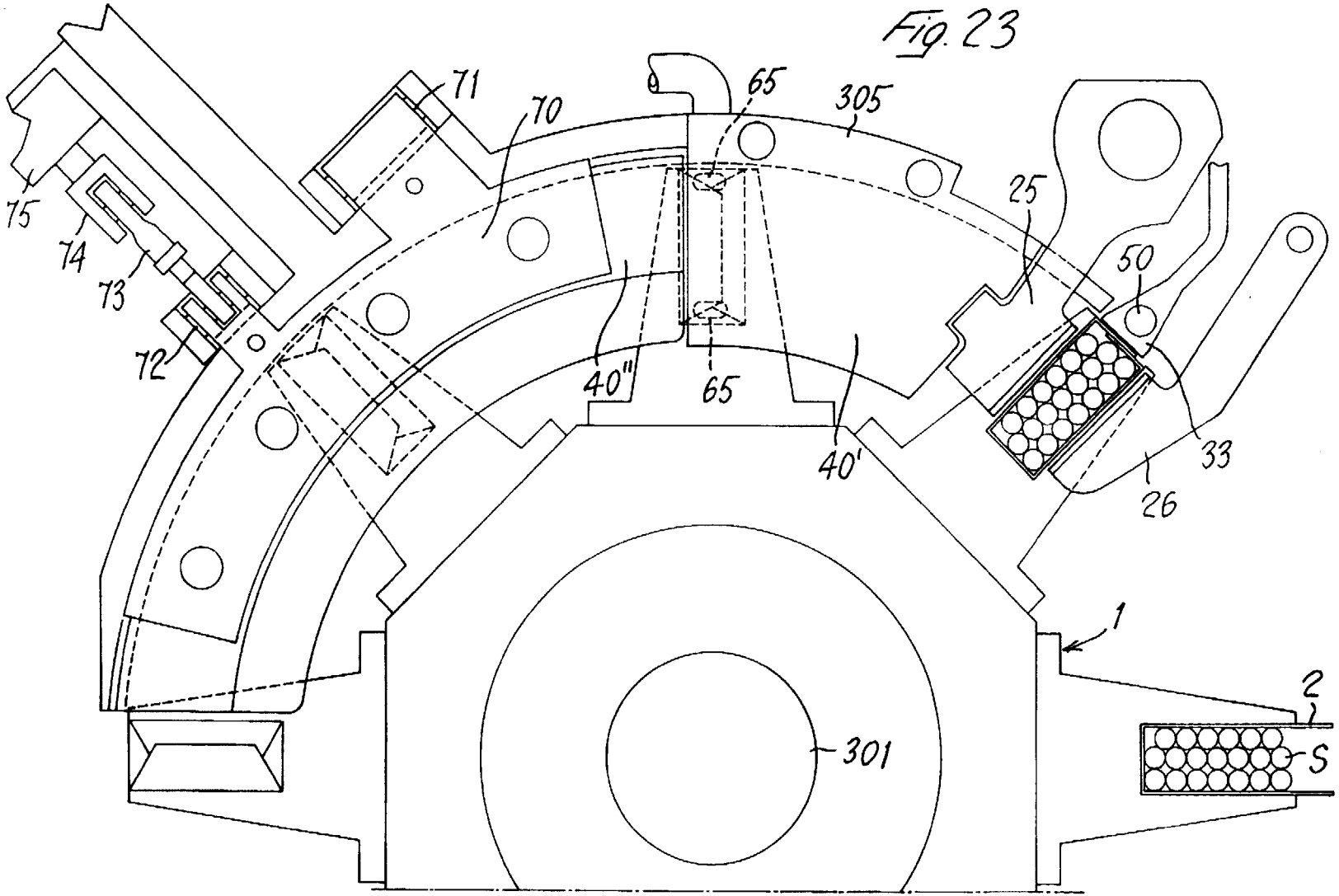
FIG. 23 shows a magnified axial view of a forming wheel provided with welding devices and means for air suction and/or injection from and/or into the group of cigarettes wrapped in the wrapping slip, according to a variant embodiment of the invention.
Figure 25:
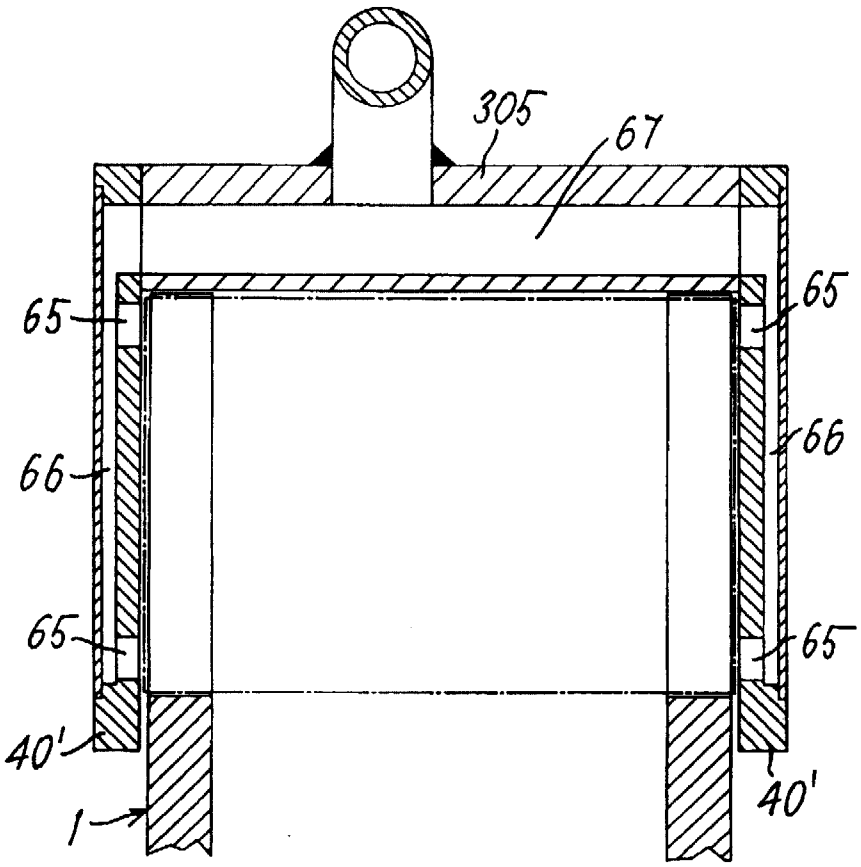
FIG. 25 shows a section, transverse with respect to a radial plane, of the station for air suction and/or injection.

In the subsequent arc of the path of the second step of advance, the forming wheel 1 is associated with an extension of the peripheral coaxial cylindrical wall 305' to keep the axial flaps 102, 202 in the folded condition, together with a sliding surface 140 of a lateral wall 40 on each side of the forming wheel 1, to keep the wings 402, 502, 602, 702 in the folded condition on the ends of the group of cigarettes, along which surfaces the outer rear wings 502' of the end of the packaged group of cigarettes slide in a pleated condition (see FIG. 18). To enable the wings 502' to pass from the area of the folding blade 25 to the stationary surface 140 without striking the facing leading edge of the sliding surface 140, the front folding blades 25 and the leading portions, facing these blades, of the lateral walls 40 forming the surfaces 140, have complementary recesses or taperings for mutual engagement 425, 240 on the sides facing each other. The whole is made in such a way that, in the position of the end of travel in the direction of advance of the forming wheel 1, the folding blades 25 are engaged with the walls 40, whose inner surfaces are substantially flush with the inner surfaces of the portions 525 of the blades 25 on the side of the folding edge. The folding process as described above, and consisting in the operation in rapid succession of the folding means 6, 605, 15, 25, 26 at a speed markedly higher than that of the recovery, in other words the elastic return, of the folding flaps or wings 102, 202, 402, 502, 602, 702 in the folded position or in an intermediate folding position, is not applicable to all wrapping materials. In particular, when slips of polypropylene or plastic materials with similar elastic behaviour or resistance to folding are used as wrapping materials, the operating speeds required, in particular for the operation of the folding blocks 15 and the front folding blade 25, may become excessively high. In order to avoid such problems, the invention includes a variant shown in FIGS. 19 to 22. In this variant, the edge 215 of the folding block 15 about which the block 15 oscillates does not have a length substantially identical to the side and to the tangential wing 602, 702, as in the preceding example shown in FIGS. 8 to 18; instead, the edge 215' and consequently the blocks 15' are made shorter than the corresponding tangential wings 602, 702 on the side facing the front folding blade 25, and leave free a strip 902 on which part of the radial wing 402 can be overlapped before the start of the return travel of the blocks 15. This is done by means of the operation of the front folding blade 25 for the execution of the folding travel with a certain predetermined advance with respect to the start of the return travel of the folding blocks 15. The dimensions of the peripheral strip 902 and the advance, as well as the speed of advance of the blocks 15' and the front folding blade 25 are such that when it is overlapped by a sufficient amount to keep the tangential wings 602, 702 temporarily in the folded position and at a predetermined minimum distance from the blocks 15 (FIG. 20), these blocks start their return travel to the rest position at a speed such that interference with the folding blade 25 is avoided.

With reference in particular to FIG. 1, the forming wheel 1 is associated with means of welding the flaps 102, 202 and the wings 402, 502, 602, 702 of the wrapping slip 2 which have been folded and overlapped on each other on the corresponding sides of the group of cigarettes S. The welding means may be of any type. They may consist of welding heads which are provided at a station following the folding station of the corresponding flaps or corresponding wings 102, 202, 402, 502, 602, 702, and which are supported so that they can be moved alternately into the active welding position against the corresponding sides of the group of cigarettes, on which the flaps and wings are folded, through apertures made in the walls 305, 305', 40. A solution of this type is known and is commonly used in cellophane wrapping machines. In the present example, a welding unit of this type may be formed, for example, by the retaining plate 33 which may carry on its rear face a suitable heater 50 which brings it to, and keeps it at, the welding temperature.

Alternatively, the welding means may also consist of the walls 305, 305' and 40, against which slide the sides of the group of cigarettes on which the flaps or wings 102, 202, 402, 502, 602, 702 are folded and overlapped on each other. This type of welder is also known and used in the field of cellophane wrapping machines. On the walls 305, 305', 40 there are provided heating means 51 which are distributed suitably over the extension of the walls 305, 305', 40 and which bring the walls or predetermined parts of them to the welding temperature. The flaps and wings 102, 202, 402, 502, 602, 702 are welded together during their sliding on the heated walls.

The welding of the flaps or wings 102, 202, 402, 502, 602, 702 may take place immediately after each individual phase of folding of the flaps or wings on the corresponding side, or when the wrapping slip has been completely folded around the group of cigarettes in the path after the folding station P.

The wrapping slip 2 may be made of various types of plastic material. Some types may consist of thermoplastic and heat-weldable resins currently in use particularly in the field of packaging, for example polypropylene, polyvinyl butyral, known as PVB, ethylene vinyl acetate, known as EVA, or ionomeric resins.

According to an improvement, a vacuum or a low pressure may be created inside the package formed by the wrapping sheet folded around the group of cigarettes and welded.

Figure 3:
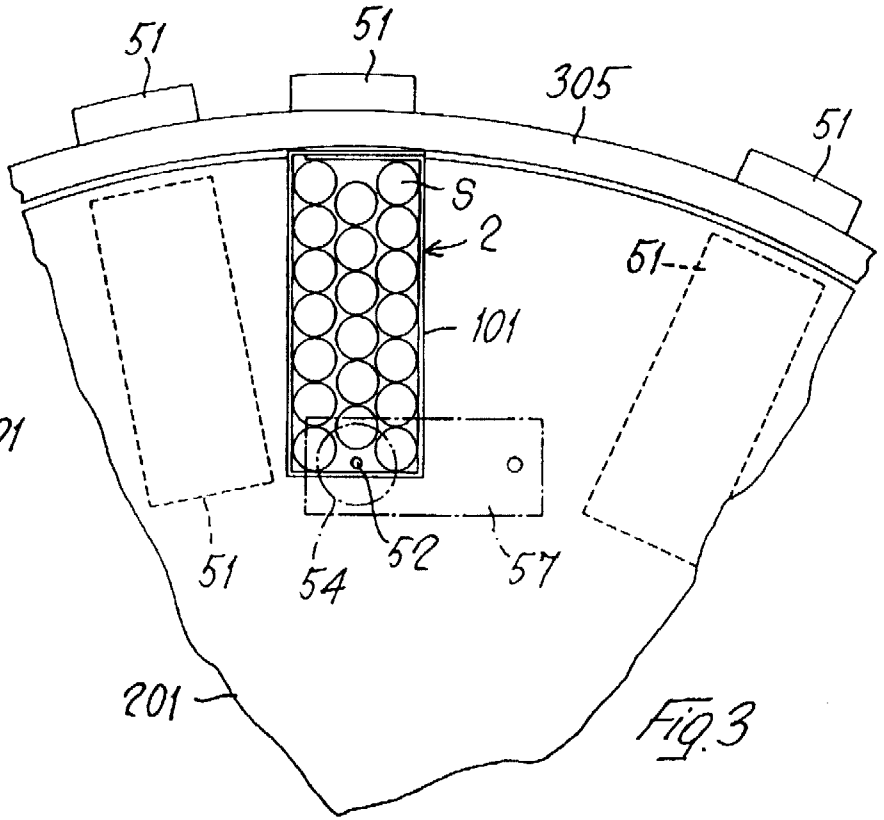
FIG. 3 is a view of the end of the packet, transverse with respect to the cigarettes of the group, in which the position of the suction needle is shown.
Figure 2:
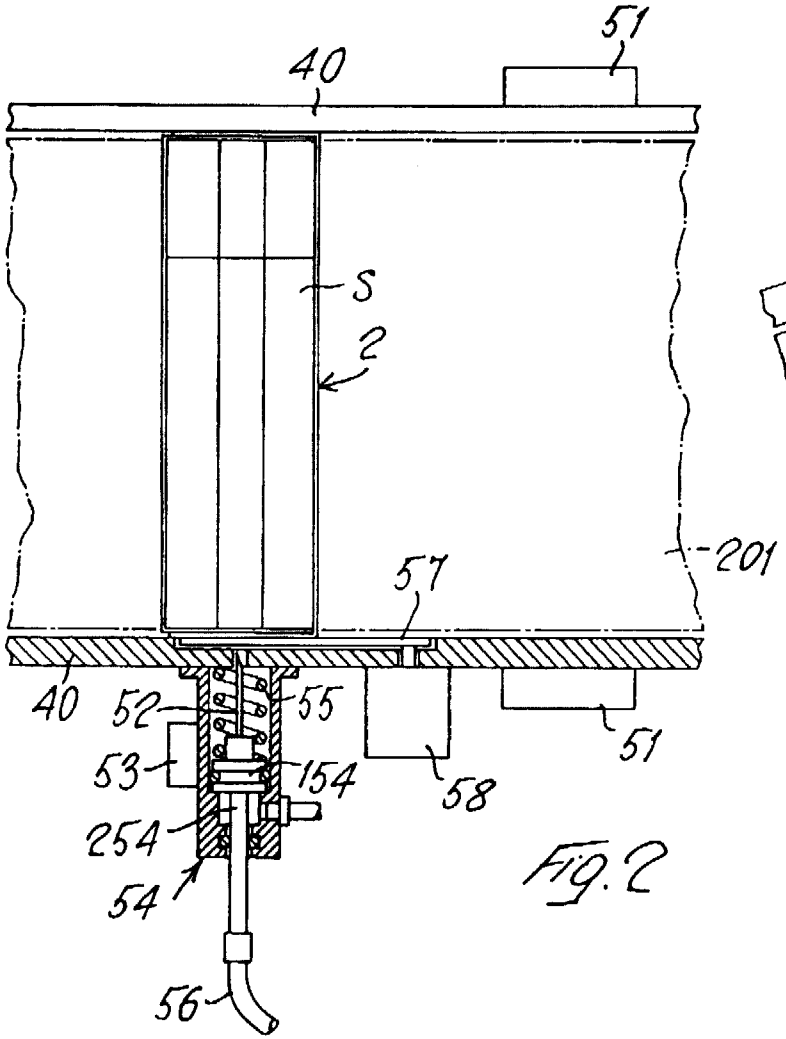
FIG. 2 is a schematic view of the means for creating the vacuum or low pressure.

FIGS. 2 and 3 show schematically and purely by way of example means for creating the vacuum or low pressure, consisting of a needle 52 which is heated by a heater 53, this needle being orientated with its axis parallel to the axes of the cigarettes S and coinciding with a free space among the cigarettes S. The suction needle 52 is movable axially alternately between a position in which it is withdrawn from the group of cigarettes and a position in which it penetrates into the empty space among the cigarettes S through a perforation of the corresponding side of the wrapping sheet 2. In the example illustrated, the needle 52 is pushed by a piston 154 of an actuating cylinder 54 into the penetration position, and is returned to the withdrawn position by an elastic opposing element 55. The rod of the piston 154 is tubular and forms the union for connection to the suction line 56. The plastic materials used enable the hole to be closed by the fluidity of the material after the extraction of the heated needle 52. Alternatively, or in combination with the above, means may also be provided for the closure of the hole made by the suction needle 52, such as an oscillating blade 57 with a drive unit 58.

Instead of creating vacuum inside the wrapping of the group of cigarettes, advantages can result from the injection of air or gas containing a predetermined amount of humidity. During the different processing phases, the tobacco contained in the cigarettes can be subject to drying, and its relative humidity, in the packaging phase may not correspond to that prescribed by the law. In this case, the injection of a certain amount of humid air or gas, containing a predetermined quantity of steam, allows to restore the optimal conditions of tobacco. These conditions are naturally maintained through the sealing by welding of the wrapping slip, wrapped around each group of cigarettes.

FIGS. 23 to 26 show a variant embodiment of the welding devices and the means for suction, to create a low pressure inside the wrapping, and/or injection, to introduce a certain amount of humid air or gas into the wrapping.

The welder of the axial flaps 102, 202 of the wrapping 2 on the radially outer side of the tubular wrapping still comprises the retaining plate 33 with the associated heating means 50. In this embodiment, the plate 33 has a trapezoidal section and the heating means are inserted in a particular housing, for example a hole, a recess, or similar, which are made inside the plate 33.

The folding of the wings 402, 502, 602, 702 onto the ends of the wrapping is executed in a way which is substantially the same as the one described above. In this case, but also in the preceding one, the radial wing 402, that is the front wing with respect to the rotation of the forming wheel, can be folded last, onto the radial rear wing 502. The lateral wall 40 along which the ends of the wrapping slide, during the steps of advance of the wheel, into the stations following the station for folding the flaps 402, 502, 602, 702, is composed of two separate portions, indicated in FIG. 23 as 40' and 40". The first portion 40' is stationary and extends from the folding and side welding station of the end flaps 402, 502, 602, 702, to a subsequent station of suction and/or injection of air or gas from or into the wrapping. In the suction and/or injection station, the end of the lateral wall 40' is slightly withdrawn from the radial, axial, frontal side of the wrapping which is already between the two moving walls 40", the latter being the welding means for the ends of the wrapping and the extensions of the stationary lateral walls 40'. In the walls 40', in substantial coincidence with the radially outer and inner edges of the radial folded wings 402, 502, particularly in their crossing area, there are provided some suction and/or injection slot-like outlets 65 orientated so as to be substantially tangential with respect to the circular path of the groups of cigarettes wrapped in the wrapping 2. The suction and/or injection outlets 65 are provided in a coinciding position on both the facing lateral walls 40' and are connected by means of radial feed lines 66, to a common manifold 67 whose position is axial and radially outside the wheel inside a peripheral tunnel 305. The peripheral tunnel can also house further heating means 50. The manifold 67 communicates through connecting tubing 66 with a source providing low pressure, or feeding air or gas containing a predetermined amount of humidity.

The extensions of the stationary lateral walls 40' are the moving lateral walls 40", which are particularly oscillating between an idle position in which they oscillate outwards and keep a distance from the ends of the wrapping, and an operated position, in which they adhere to the said ends and extend flushing with the inner surfaces of the stationary lateral walls 40', in a complanar way. The oscillating lateral walls 40" are provided with heating means 51 and are supported by oscillating L- shaped wings 70, which have a branch parallel to the oscillating lateral walls 40" and a branch transverse to them, that is orientated axially with respect to the wheel. The oscillating wings are arched coaxially with respect to the forming wheel and are hinged with pins 71, 72 in at least one point, preferably two points, around a tangential axis. In a position eccentric with respect to the hinging axis, that is more exterior with reference to the transverse median plane of the forming wheel, the oscillating wings are hinged each to an operating arm 73. The arms 73 are hinged to an axial crosspiece 74, which is fixed to a linear actuator 75, for example pneumatic, hydraulic, electrical, or similar, whose moving sense or direction is orientated radially with respect to the wheel. By this arrangement, the travel of the linear actuator 74 makes the wings 70, and hence the lateral walls 40", oscillate outwards and against the ends of the cigarettes. This is a very advantageous characteristic, as it allows to move the welders away from the wrappings in case of machine stop. For their construction, these welders have a very high heat capacity, and they substantially maintain the temperature of welding for a relatively long period, even when the heating means are off. Therefore, in case of machine stop, the groups of cigarettes wrapped in the wrapping foil which are between the lateral welders can also catch fire or anyway be overheated, thus leading to serious drawbacks and damages.

With reference to FIG. 24, the stationary lateral walls 40' and the oscillating lateral walls 40" have facing radial edges very close to each other, while the suction and/or injection slot-like outlets terminate at a very short distance from the radial edge of the stationary walls 40', this edge facing the oscillating lateral walls 40". Moreover, the outlets 65 are so wide that, as the forming wheel progressively advances, the edges of the radial wings progressively interact with the moving lateral walls 40", that is with the welding devices of the ends of the wrapping, with their front portions, while the rear portions, which are nor subject to sealing yet, are still coinciding with the suction and/or injection outlets. All this is designed in such a way, that when the final portions of the edges of the radial folded wings 402, 502, leave the suction and/or injection outlets 65, the forming wheel has already substantially reached the highest speed of its rotation step, or anyway enough speed as to allow to keep the vacuum or the injected air or gas at a sufficient level as to ensure the effect of conservation and/or restore of the relative humidity of tobacco, for the whole period in which the not-welded portions of the edges of the radial wings 402, 502 pass from the suction and/or injection outlets 65 to the moving lateral walls 40", in other words to the welder.

During the whole of the step of advance of the wrapping from the suction and/or injection station to the welding/ sealing station for its ends, the suction or feeding of air or gas containing a predetermined amount of humidity by the outlets 65 are kept operating.

The low pressure or the amount of air or gas containing a predetermined quantity of relative humidity, injected inside the wrapping, can be also maintained at the desired levels, by providing a suction at higher vacuum levels than the desired ones or an injection with higher pressure than the final one, so that the losses eventually occurring while the final portions of the edges of the radial refolded wings 402, 502 pass form the suction and/or injection outlets to the welding lateral walls 40" can be widely compensated.

In order to reduce the very small losses of vacuum and/or gas injected into the wrapping, there can also be provided some open suction/injection outlets at the edge or even in the initial portion of the welding lateral walls 40".

The package according to the invention may have predetermined opening means of any type, such as predetermined tear strips, etc. The packaging wrapping may also be completely transparent or opaque or partially transparent and may have different colours and designs or similar printed on it.

The package according to the invention may form the finished package of the cigarettes or an inner package, as is currently done with foil slips in soft packs and rigid packs of cigarettes.

Figure 27:
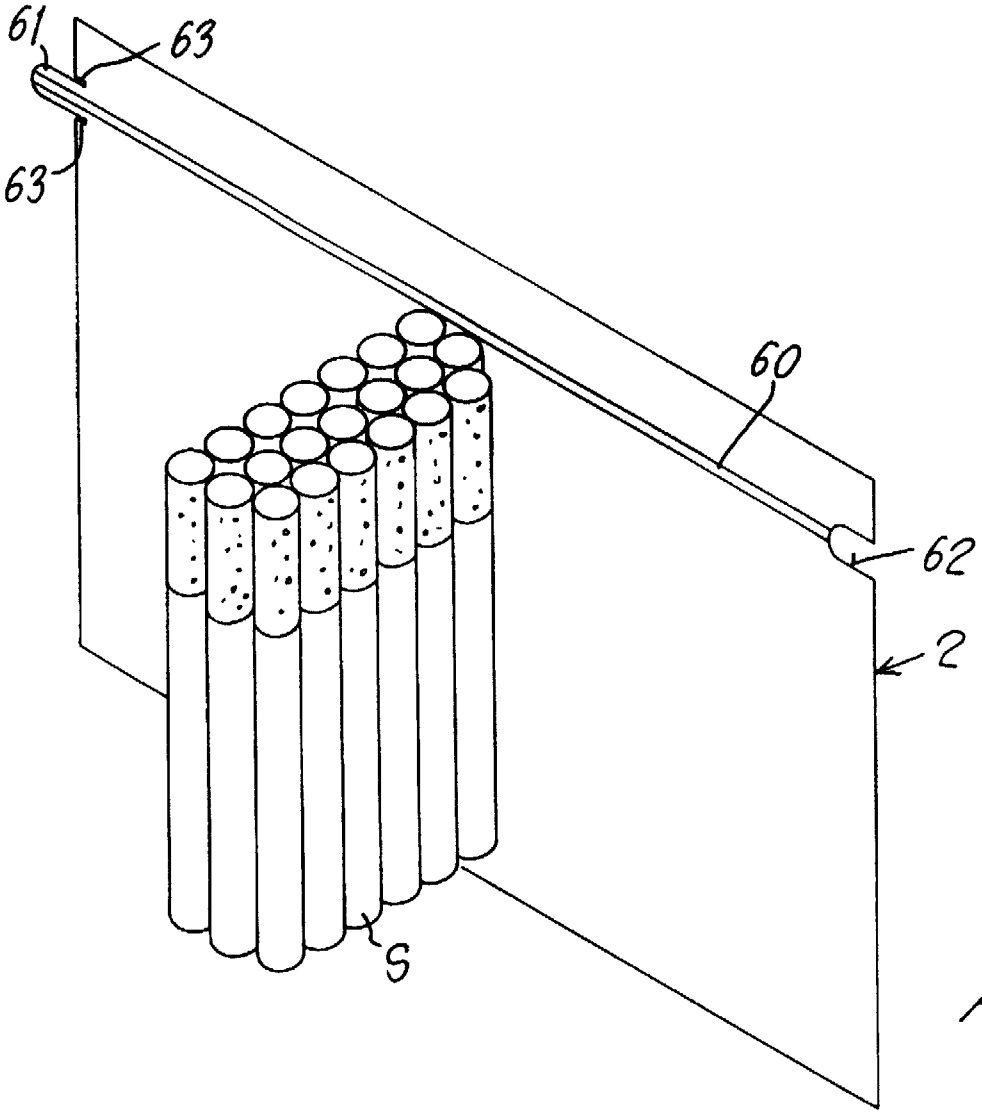
FIGS. 27 to 29 show a wrapping slip, particularly of heat-weldable material, in an unfolded state, next to a group of cigarettes, folded around the group of cigarettes, and folded around the group of cigarettes and inserted with it as an inner wrapping into a rigid box with an overturning cover for cigarettes respectively.
Figure 29:
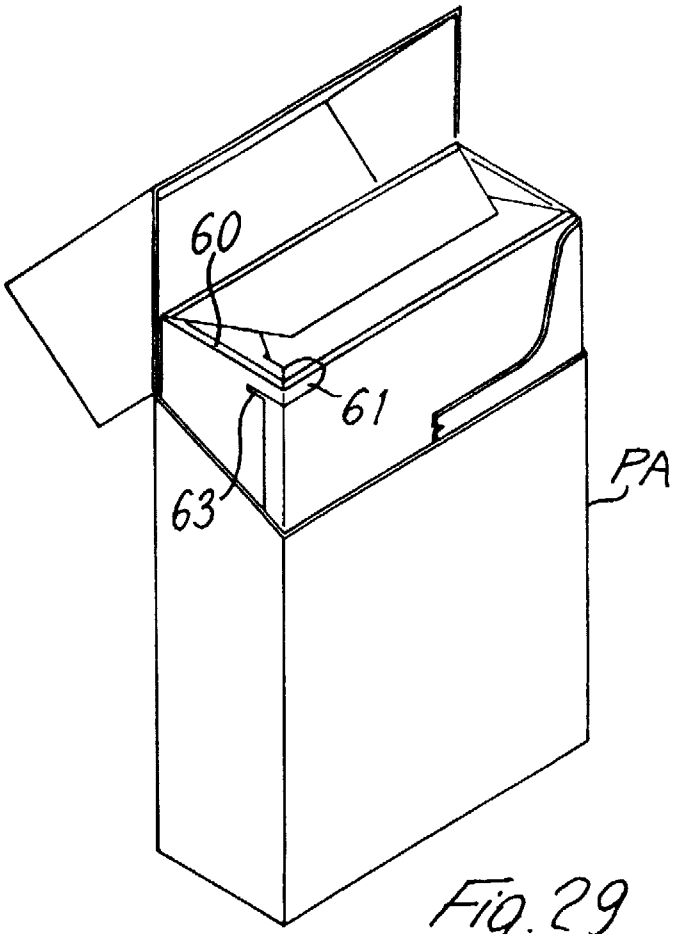
Figure 28:
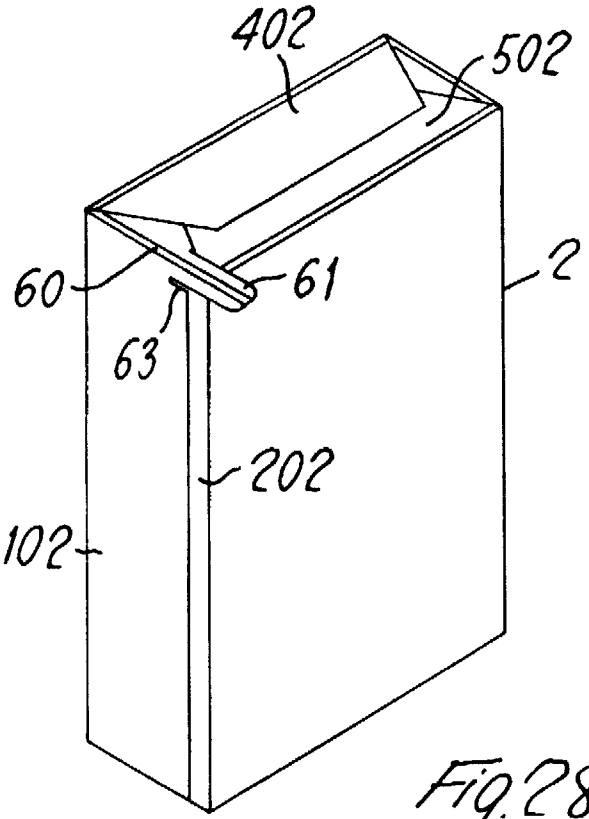

FIGS. 27 to 29 show an example of such a wrapping slip. In this case, the slip 2 has a predetermined tear strip 60 extending transversely to the axis of the cigarettes S and in such a position, to be substantially at the ends of the filters of the cigarettes, that is at their ends on the opening side of the pack. The predetermined tear strip extends on one side onto a grasping tongue 61 of the wrapping slip 2, while the opposite end of the strip ends into a notch 62 of the wrapping slip, whose shape is substantially identical to the tongue. The tongue 61 is separated from the slip 2, up to a certain extent, by two notchings 63 parallel to each other and to the direction of the tear strip.

According to a further characteristic, as shown in FIGS. 28 and 29, the predetermined tear strip 60 is provided in such a position that, while the slip 2 is folded around the group of cigarettes, it coincides substantially with the peripheral edge of the end of the wrapping on the opening side of the pack P. The tongue 61, whose transverse size is defined by the two notchings 63, which define substantially the border between the tongue itself and the rest of the wrapping, is disposed astride of the peripheral edge of the end of the wrapping, therefore when tearing the tongue, the edge of the portion of the wrapping slip which remains inside the pack, extends slightly under the ends of the cigarettes, so that they can be easily grasped.

The wrapping slip can be advantageously, but not by way of restriction, wrapped around the group of cigarettes, in such a relative position that, as figs. 28 and 29 show, the grasping tongue of the predetermined tear strip is situated at one of the frontal edges of the inner wrapping of the pack P. Thanks to this arrangement, when the pack is being open, the tongue can be immediately identified and easily grasped.

FIGS. 23 to 26 show a variant embodiment of the welding means for a heat-weldable wrapping slip, and of the station of air suction and/or injection from or into the package of each group of cigarettes.

Naturally, the invention is not limited to the embodiments described and illustrated herein, but may be greatly varied and modified, particularly as regards construction, without departure from the guiding principle disclosed above and claimed below.

I claim:

1. A device for fabrication of a package comprising:

an axial compartment having an open entry side, a defined bottom side opposite to the entry side, defined front and back transverse sides opposite to one another, and a central longitudinal axis parallel to said sides;

a transporting means for transporting said compartment along a radial path perpendicular to the longitudinal axis of said compartment;

a feeding means for feeding an ordered group of cylindrical products having a longitudinal axis together with a heat-weldable wrapping slip radially into the entry side of said compartment such that said slip has front and back axial flaps extending laterally outward from the entry side of said compartment;

a folding means for folding the slip about the group of products as the group of products travels along the radial path, said folding means including a first folding mechanism which folds and overlaps the axial flaps to form the slip into a tubular wrapping with open ends about the group of products, each open end extending beyond an associated axial end of the group of products and being defined by an inner tangential wing, an outer tangential wing, a front radial wing and a rear radial wing, and a second folding mechanism for folding and overlapping said wings of the open ends of the slip closed against the axial ends of the group of products;

a first welding means for welding the overlapped flaps together;

an altering means for altering an interior environment of the folded slip by one of (a) creating a low pressure inside of each folded slip or (b) injecting a gas containing a predetermined amount of humidity inside of each folded slip, said altering means including opposed stationary lateral walls disposed along the radial path on respective axial sides of the group of products and which engage and maintain the overlapped wings against the respective axial end of the group of products, and inner and outer slot outlets in each said stationary lateral wall having a longitudinal axis orientated along the radial path and through which the environment of the folded slip is altered, said inner slot outlet being positioned so that an inner crossover of said radial wings passes thereby and said outer slot outlet being positioned so that an outer crossover of said radial wings passes thereby; and a second welding means for welding the overlapped wings of the folded slip to form a hermetic seal about the group of products with the altered interior environment as the group of products travels along the radial path.

2. A device for fabrication as claimed in claim 1:

wherein said altering means further includes a downstream radial edge of each of said lateral walls which is spaced further from a respective axial end of the group of products than a remainder of said lateral wall.

3. A device for fabrication as claimed in claim 1:

wherein said second welding means comprises opposed heated plates which respectively engage opposed axial ends of the group of products against which the overlapped wings are closed as the group of products move along the radial path, each said heated plate being located immediately downstream from a respective said lateral wall and forming an extension thereof; and wherein said slot outlets in said lateral walls are located adjacent to a respective said heated plate such that, when said front side of said compartment is axially adjacent said heated plates, said back side of said compartment is axially adjacent said slot outlets.

4. A device for fabrication as claimed in claim 3:

wherein each said lateral wall and respective said heated plate include adjacent edges which are positioned immediately adjacent one another.

5. A device for fabrication as claimed in claim 4:

further including a moving means for selectively moving said heated plates between an operating position where said heated plates engage respective axial ends of the group of products located in the radial path and an idle position where said heated plates are spaced away from the axial ends of the group of products in the radial path.

6. A device for fabrication as claimed in claim 5:

wherein said first folding mechanism is provided at a feed station; and wherein said second folding mechanism is provided at a single folding station.

7. A device for fabrication as claimed in claim 6:

wherein said first folding mechanism includes a back flap folder which folds the back axial flap against an adjacent axial side of the group of products leaving a peripheral strip of the back axial flap adjacent the front axial flap free from engagement with the back axial folder, a front flap folder which folds the front axial flap against the back axial flap so that the front axial flap is at least partially superimposed on the back axial flap, and a controlling means for controlling movements of said back flap folder such that (a) said back flap folder completely folds the back axial flap against the adjacent axial side and holds the back axial flap in place until an initial folding movement of said front flap folder is made to at least partially superimpose the front axial flap on the peripheral strip of the back axial flap, and (b) said back flap folder completes a return movement after the peripheral strip is superimposed by the front axial flap; and wherein said second folding mechanism includes, for each axial end of the group of products, an inner tangential wing folder which folds the inner tangential wing against an adjacent axial end of the group of products, said inner tangential wing folder terminating a distance from an adjacent front radial wing when said inner tangential wing folder is in a folded position against the adjacent axial end leaving an inner strip adjacent the front radial wing free from said inner tangential wing folder, an outer tangential wing folder which folds the outer tangential wing against an adjacent axial end of the group of products, said outer tangential wing folder terminating a distance from an adjacent front radial wing when said outer tangential wing folder is in a folded position against the adjacent axial end leaving an outer strip adjacent the front radial wing free from said outer tangential wing folder, a front radial wing folder which folds the front radial wing against an adjacent axial end of the product and over the folded inner and outer tangential wings, said front radial wing folder terminating a distance from an adjacent rear radial wing when said front radial wing folder is in a folded position overlapping both said inner and outer tangential wings against the adjacent axial end leaving a front strip adjacent the rear radial wing free from said front radial wing folder, a rear radial wing folder which folds the rear radial wing against an adjacent axial end of the product and over the folded inner and outer tangential wings and front radial wing, and a control means for controlling movements of said inner and outer tangential wing folders and of said front and rear radial folders (a) such that said front radial wing folder moves to an initial position to cover the inner and outer strips when said inner and outer tangential folders are in the respective folded positions, and then said inner and outer tangential folders are moved to an idle position after the inner and outer strips are covered by the front radial wing and said front radial wing folder is moved to the folded position, and (b) such that said rear radial wing folder moves to an initial position to cover the front strip when said front radial wing folder is in the folded position, and then said front radial wing folder is moved to an idle position after the front strip is covered by the rear radial wing and said rear radial wing folder is moved to the folded position.

8. A method for fabrication of a package comprising the steps of:

locating, at a feeding station, an axial compartment having an open entry side, a defined bottom side opposite to the entry side, defined front and back transverse sides opposite to one another, and a central longitudinal axis parallel to the sides;

feeding an ordered group of cylindrical products having a longitudinal axis together with a heat-weldable wrapping slip radially into the entry side of the compartment such that the slip has front and back axial flaps extending outward from the entry side of the compartment;

folding and overlapping, at the feeding station, the axial flaps to form the slip into a tubular wrapping with open ends about the group of products, each open end extending beyond an associated axial end of the group of products and being defined by an inner tangential wing, an outer tangential wing, a front radial wing and a rear radial wing; and moving the compartment to a folding station along a radial path perpendicular to the longitudinal axis of the compartment;

folding and overlapping, at the folding station, the wings of the open ends of the slip closed against the axial ends of the group of products;

welding the overlapped flaps together;

moving the compartment toward an exit station along the radial path;

altering, as the compartment is moved to the exit station, an interior environment of the folded slip by one of (a) creating a low pressure inside of each folded slip or (b) injecting a gas containing a predetermined amount of humidity inside of each folded slip, the altering step including the steps of disposing stationary lateral walls along the radial path on respective axial sides of the group of products which engage and maintain the overlapped wings against the respective axial end of the group of products, and providing inner and outer slot outlets in each the stationary lateral wall having a longitudinal axis orientated along the radial path and through which the environment of the folded slip is altered, the inner slot outlet being positioned so that an inner crossover of the radial wings passes thereby and the outer slot outlet being positioned so that an outer crossover of the radial wings passes thereby; and welding the overlapped wings of the folded slip to form a hermetic seal about the group of products with the altered interior environment as the group of products travels along the radial path to the exit station.

9. A method for fabrication as claimed in claim 8:

wherein said altering step further includes the providing of a downstream radial edge of each of the lateral walls which is spaced further from a respective axial end of the group of products than a remainder of the lateral wall.

10. A method for fabrication as claimed in claim 8:

wherein said welding of the overlapped wings step includes the step of engaging opposed heated plates respectively with opposed axial ends of the group of products against which the overlapped wings are closed as the group of products move along the radial path, each the heated plate being located immediately downstream from a respective lateral wall and forming an extension thereof; and wherein the slot outlets in the lateral walls are located adjacent to a respective the heated plate such that, when the front side of the compartment is axially adjacent the heated plates, the back side of the compartment is axially adjacent the slot outlets.

11. A method for fabrication as claimed in claim 10:

wherein each lateral wall and respective heated plate include adjacent edges which are positioned immediately adjacent one another.

12. A method for fabrication as claimed in claim 11:

wherein said welding of the overlapped wings step includes the step of selectively moving the heated plates between an operating position where the heated plates engage respective axial ends of the group of products located in the radial path and an idle position where the heated plates are spaced away from the axial ends of the group of products in the radial path.

13. A method for fabrication as claimed in claim 12:

wherein said folding and overlapping the axial flaps step includes the steps of folding, with a back axial folder, the back axial flap against an adjacent axial side of the group of products leaving a peripheral strip of the back axial flap adjacent the front axial flap free from engagement with the back axial folder, folding, with a front flap folder, the front axial flap against the back axial flap so that the front axial flap is at least partially superimposed on the back axial flap, and controlling movements of the back flap folder such that (a) the back flap folder completely folds the back axial flap against the adjacent axial side and holds the back axial flap in place until an initial folding movement of the front flap folder is made to at least partially superimpose the front axial flap on the peripheral strip of the back axial flap, and (b) the back flap folder completes a return movement after the peripheral strip is superimposed by the front axial flap; and wherein said folding and overlapping the wings of the open ends of the slip step includes, for each axial end of the group of products, the steps of folding, with an inner tangential wing folder, the inner tangential wing against an adjacent axial end of the group of products, the inner tangential wing folder terminating a distance from an adjacent front radial wing when the inner tangential wing folder is in a folded position against the adjacent axial end leaving an inner strip adjacent the front radial wing free from the inner tangential wing folder, folding, with an outer tangential wing folder, the outer tangential wing against an adjacent axial end of the group of products, the outer tangential wing folder terminating a distance from an adjacent front radial wing when the outer tangential wing folder is in a folded position against the adjacent axial end leaving an outer strip adjacent the front radial wing free from the outer tangential wing folder, folding, with a front radial wing folder, the front radial wing against an adjacent axial end of the product and over the folded inner and outer tangential wings, the front radial wing folder terminating a distance from an adjacent rear radial wing when the front radial wing folder is in a folded position overlapping both the inner and outer tangential wings against the adjacent axial end leaving a front strip adjacent the rear radial wing free from the front radial wing folder, folding, with a rear radial wing folder, the rear radial wing against an adjacent axial end of the product and over the folded inner and outer tangential wings and front radial wing, and controlling movements of the inner and outer tangential wing folders and of the front and rear radial folders (a) such that the front radial wing folder moves to an initial position to cover the inner and outer strips when the inner, and outer tangential folders are in the respective folded positions, and then the inner and outer tangential folders are moved to an idle position after the inner and outer strips are covered by the front radial wing and the front radial wing folder is moved to the folded position, and (b) such that the rear radial wing folder moves to an initial position to cover the front strip when the front radial wing folder is in the folded position, and then the front radial wing folder is moved to an idle position after the front strip is covered by the rear radial wing and the rear radial wing folder is moved to the folded position.

* * * * *